US007097574B2

(12) United States Patent
Nye et al.

(10) Patent No.: US 7,097,574 B2
(45) Date of Patent: Aug. 29, 2006

(54) BASKETBALL SYSTEM

(75) Inventors: S. Curtis Nye, Clinton, UT (US); Robert A. Astle, Fannington, UT (US); Christopher A. Parada, Ogden, UT (US); Kevin Bingham, deceased, late of Farmington, UT (US); by Kathleen W. Bingham, legal representative, Farmington, UT (US); David C. Winter, Layton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/737,034

(22) Filed: Dec. 15, 2003

(65) Prior Publication Data

US 2004/0185971 A1 Sep. 23, 2004

Related U.S. Application Data

(60) Provisional application No. 60/434,073, filed on Dec. 16, 2002, provisional application No. 60/445,570, filed on Feb. 5, 2003.

(51) Int. Cl.
*A63B 63/08* (2006.01)

(52) U.S. Cl. ..... 473/481; 473/484; D21/701

(58) Field of Classification Search ..... 473/481, 473/486, 479, 476, 484, 472, 485; D21/701–703
See application file for complete search history.

(56) References Cited

U.S. PATENT DOCUMENTS 3,233,897 A 2/1966 Sheets
3,365,196 A * 1/1968 Miller ..... 473/485
3,603,588 A 9/1971 Ebstein
3,788,642 A 1/1974 Matras et al.
3,964,743 A 6/1976 Salsich, Sr.
3,970,304 A * 7/1976 Ebstein et al. ..... 473/481
4,320,896 A 3/1982 Engle et al.
4,372,555 A 2/1983 Sorensen
4,478,415 A 10/1984 Schaffer et al.
4,723,777 A 2/1988 Jolly
4,826,162 A 5/1989 Allen
4,895,365 A * 1/1990 Schroeder ..... 473/481
5,154,414 A 10/1992 Auer et al.
5,586,759 A 12/1996 Fitzsimmons et al.
5,597,158 A 1/1997 Spikes
5,722,902 A 3/1998 Dupree
5,827,136 A 10/1998 Halter et al.
5,839,982 A 11/1998 Hying et al.
5,893,809 A * 4/1999 Coats et al. ..... 473/479

(Continued)

*Primary Examiner*—Eugene Kim
*Assistant Examiner*—M. Chambers
(74) *Attorney, Agent, or Firm*—Workman Nydegger

(57) ABSTRACT

A basketball goal system may include a backboard, an elongated support that positions the backboard above a playing surface, a backboard support assembly that connects the backboard to the elongated support, and a goal support assembly with a rim and a support member. Preferably the support member is attached to the backboard support assembly behind a plane that is generally aligned with the front surface of the backboard. In addition, the basketball goal system may include a resistance mechanism to create a breakaway type basketball rim. The resistance mechanism is also preferably positioned behind a plane that is generally aligned with the front surface of the backboard. Advantageously, the basketball goal system may be part of a portable basketball system and/or a basketball system in which the height of the backboard and rim is adjustable relative to the playing surface.

27 Claims, 19 Drawing Sheets

U.S. PATENT DOCUMENTS 5,916,047 A 6/1999 Schickert et al.
5,947,847 A * 9/1999 van Nimwegen et al. .. 473/481
5,980,400 A 11/1999 Schickert
5,980,401 A 11/1999 Erlewine
6,004,231 A 12/1999 Schickert et al.
6,120,396 A 9/2000 Van Nimwegen et al.
6,186,911 B1 2/2001 Manthey
D445,857 S 7/2001 Schickert et al.
6,283,878 B1 9/2001 White
6,419,597 B1 7/2002 Van Nimwegen et al.

* cited by examiner

BASKETBALL SYSTEM

CROSS-REFERENCE TO RELATED APPLICATIONS

This application claims priority to and the benefit of U.S. Provisional Patent Application Ser. No. 60/434,073, entitled Modern Basketball System, which was filed on Dec. 16, 2002, and U.S. Provisional Patent Application Ser. No. 60/445,570, entitled Modern Basketball System, which was filed on Feb. 5, 2003, which are hereby incorporated by reference in their entirety.

BACKGROUND OF THE INVENTION

1. Field of the Invention

This invention is generally related to a basketball system and, in particular, to a basketball goal that may include features such as a breakaway rim, curved support arms, curved support pole and/or a backboard with a curved outer surface.

2. Description of Related Art

The game of basketball is played by many people throughout the United States and the world. Briefly, the game of basketball includes a flat and level playing surface with a basketball goal at each end of the court. The basketball goal typically includes a support pole with a backboard and rim or hoop attached to the top of the support pole. The rim or hoop is normally located ten feet above the playing surface and the backboard is constructed from materials such as tempered glass.

Conventional basketball goals include rigidly mounting the hoop to the basketball backboard so that the face of the backboard is positioned perpendicular to the playing surface and the hoop is positioned parallel to the playing surface. The mounting of the hoop to the backboard must be sufficiently rigid so that the hoop is capable of withstanding various forces and impacts during the game of basketball. For example, the hoop must remain in a generally stationary position so that the basketball rebounds and bounces off the rim in a consistent, dependable manner. In addition, the hoop must be able to withstand various impacts by the players during the game.

In recent years it has become increasingly popular to "dunk" the basketball in which the basketball is thrown through the hoop with great force and velocity. In particular, the basketball is thrown through the hoop from a position above the rim. While it is possible to dunk the basketball without the basketball or the player touching the rim, it is not uncommon for a player to strike the rim with the basketball and/or his or her hands and arms while dunking the basketball. A player may also grab and/or suspend themselves from the rim after dunking the basketball. In addition, a player may strike the rim while playing or practicing to play basketball. For example, a player may strike the rim while playing defense such as when one blocks or attempts to block another person's shot. These forces caused by dunking the basketball and players contacting, grabbing or suspending themselves from the rim impart substantial forces on the goal.

If the force applied to the basketball rim is of sufficient magnitude, many problems could result. For example, if the basketball backboard is constructed from tempered glass, the force may shatter the glass. This may result in injury to players surrounding the goal and spectators in the immediate area. In addition, the tempered glass backboard has to be replaced before the game can be continued. Unfortunately, replacing the glass backboard often requires a substantial amount of time and that may result in an unacceptable delay of the basketball game. Additionally, tempered glass backboards are very expensive and it may be prohibitively expensive to replace glass backboards each time they are damaged.

Known basketball backboards are also constructed from materials other than tempered glass. For example, known basketball backboards may also be manufactured using thermoformed plastic. Thermoformed plastic is a relatively strong material, but it is also brittle. The brittle nature of the thermoformed plastic makes it susceptible to cracking or shattering upon impact. Accordingly, basketball backboards constructed from thermoformed plastic are vulnerable to being cracked and broken. In addition, basketball backboards constructed from thermoformed plastic often require the use of strengthening ribs and other reinforcement structures in order to increase the stiffness and rigidity of the backboard. These ribs and reinforcement structures often detract from the aesthetics of the backboard and add to the complexity of the design and manufacturing process. The ribs and reinforcement structures may also increase the costs and time required to construct the backboard. Further, many thermoformed plastic basketballs are formed from two or more pieces that must be connected together, which generally requires additional time and parts to assemble. Therefore, thermoformed plastic backboards are relatively costly to manufacture and have many disadvantages.

Basketball backboards constructed from thermoformed plastic, however, are generally more resistant to shattering or breaking in comparison to basketball backboards constructed from tempered glass. The forces applied to the rim when a player dunks the basketball or otherwise contacts the rim may still damage the backboard even if it is constructed from thermoformed plastic. In addition to breaking or damaging the backboard, it is also possible to bend or otherwise deform the rim. For example, if sufficient force is applied to the rim, the rim may bend from its horizontal position into a deformed, angled configuration. This is very undesirable because the rim must remain horizontal and parallel to the playing surface to play basketball. After a rim has been bent into a deformed position, it is very difficult, if not impossible, to restore the rim to its original, horizontal position. Thus, the rim must usually be replaced, which is often time consuming and difficult to accomplish. Further, rims used in connection with home, playground and portable basketball systems are more likely to be bent and deformed because these types of rims are often not as strong and durable as rims used for professional basketball games. Therefore, rims used in connection with home, playground and portable basketball systems are more likely to be damaged and in need of replacement.

It is known use a basketball rim that will "breakaway" or deflect from its original horizontal position when a threshold force is applied to the rim in order to prevent damage to the rim or backboard. In particular, when a force greater than a predetermined amount of force is applied to the rim, the rim is allowed to pivot downwardly before the rim or backboard is damaged. These known breakaway rims allow the rim to maintain its horizontal position during regular play such as when a basketball bounces off the rim. The breakaway rims, however, deflect downwardly when a substantial amount of force is applied to the rim, such as someone dunking a basketball or grabbing onto the rim, in order to absorb much of the energy applied to the rim.

Known breakaway rims, however, are often very complex and include multiple parts. Most known breakaway rims position the various mechanisms and parts in the limited space between the rim and the backboard. This small area forces the parts to be very small and spaced very close together, which increases manufacturing time and costs. This also makes these known breakaway rims very difficult to adjust and repair. Additionally, known breakaway rims often include multiple moving parts that are subject to wear over time. Disadvantageously, if the parts being to wear, that may allow the rim to be held in a less than stable and rigid position, which is very undesirable when playing basketball because the rim may undesirably "give" or move during the game. In addition, a safety hazard may be created because hands or fingers may be caught or injured in the mechanisms and parts located in front of the backboard. Further, the forwardly extending components of the breakaway rim may also create an aesthetically unpleasing design and the components may be difficult to install or replace.

As with most mechanical systems, the complexity of many known breakaway basketball rims can result in several disadvantages. For example, conventional breakaway rims are often constructed with numerous parts and components located in a very confirmed area. The numerous parts and components are often relatively expensive and the breakaway rims are frequently difficult to manufacture, which may result in an increased price to the consumer. Additionally, the complex nature of these known breakaway rims often leads to a greater frequency of failure. Further, many previous breakaway rims are constructed of materials which are not designed for outdoor use. Thus, the breakaway rims can only be used indoors or, if the breakaway rims are used outdoors, then the parts may prematurely rust or deteriorate. Finally, the relatively small components located in a very compact area make conventional breakaway basketball rims very difficult to repair and replace.

In addition, conventional breakaway rims are typically mounted directly to the basketball backboard by fasteners such as bolts or screws. Thus, holes or opening must be created in the backboard, which may weaken or decrease the structural integrity of the backboard. In addition, because the rim is attached to the backboard, significant forces may be transferred from the rim to the backboard. For example, when a player dunks a basketball or otherwise contacts the rim, then the force on the rim may be directly transmitted to the backboard. This transfer of the force from the rim to the backboard can cause unnecessary wear and/or damage to the backboard.

BRIEF SUMMARY OF THE INVENTION

A need therefore exists for a basketball goal system that eliminates the above-described disadvantages and problems.

One aspect of the invention is a basketball goal system that may include features such as a support pole, a basketball backboard, support arms for connecting the basketball backboard to the support pole, and a breakaway rim or hoop. Advantageously, the basketball goal system can include all or only a few of these features depending, for example, upon the intended use of the basketball goal system.

Another aspect is a basketball goal system with breakaway rim that allows pivotal movement of the hoop in response to an impact or force being applied to the rim. In particular, the breakaway rim allows deflection or movement of the hoop when a load or force greater than a predetermined amount is applied to the rim. Specifically, the breakaway rim normally maintains the hoop in a horizontal position that is parallel to the playing surface while the game is being played, but the breakaway rim also allows momentary deflection or movement of the rim to absorb significant impacts or forces on the rim. The momentary deflection of the rim helps prevent injury to the players and damage to the rim or backboard. Advantageously, the breakaway rim may have the feel and characteristics of a regulation, non-moving rim. In addition, the breakaway rim preferably has few moving parts, is long lasting, has a pleasing aesthetic appearance, and a relatively straight-forward design. Further, the breakaway rim may have the general appearance of a regulation, non-moving rim, especially when viewed from the front of the rim.

Yet another aspect is a basketball goal system with a load resistance mechanism that maintains the hoop in its normal position during play, allows the hoop to deflect when a force exceeding a predetermined limit is exerted on the rim, and returns the hoop to its original position after it has been deflected. The load resistance mechanism desirably includes one or more springs or other types of flexible and/or resilient members. The load resistance mechanism may also be adjustable to allow the amount of force required to deflect the rim to be adjusted.

A further aspect is a basketball goal system with a rim assembly that is preferably attached to the support pole independently of the backboard. Thus, forces applied to the rim while playing or practicing basketball are not directly transmitted to the backboard, which helps prevent damage to the backboard. Additionally, no openings or holes are formed in the backboard to attach the rim to the backboard because the rim is preferably attached to the support pole and not the backboard. Thus, because the rim is not attached to the backboard, no stress concentrations or other openings that may decrease the structural integrity of the backboard are formed in the backboard.

Another aspect is basketball goal system in which the resistance mechanism is located behind the backboard. Preferably at least a portion of the resistance mechanism is disposed behind the vertical plane of the backboard. More preferably, at least a portion of the resistance mechanism is disposed behind the support pole. In particular, the resistance mechanism may be attached to the rear surface of the support pole and completely disposed behind the backboard. Advantageously, this location helps assure that the resistance mechanism does not interfere with playing the game of basketball. Additionally, this at location may increase the ease in which the basketball goal system can be manufactured because the resistance mechanism is readily accessible and it is not located in a confined space. Further, this location may allow the resistance mechanism to be easily repaired and replaced, if necessary.

Still another aspect is a basketball goal system in which the support pole extends or cantilevers forwardly. In particular, the lower portion of the support pole may be sized and configured to be held in a generally permanently fixed position, such as a part of an in-ground basketball system. On the other hand, the lower portion of the support pole may be sized and configured to be attached to a portable basketball system. The lower portion of the support pole preferably extends upwardly in a generally vertical configuration. The upper portion of the support pole preferably includes a forwardly extending or arcing shape. Advantageously, the forwardly extending support pole may allow the backboard and rim to be placed in a desired position of a basketball court. Additionally, the forwardly extending support pole may allow for play underneath the support pole without significant disturbance to the game from the pole.

Yet another aspect is a basketball goal system with a support pole that may be adjustable in length. Significantly, the adjustable length support pole may allow the height of the basketball goal to be adjusted. For example, a conventional basketball goal is located ten feet above the playing surface, but that height may make it very difficult for children and others to play basketball. Thus, the adjustable height support pole, which allows the height of the goal to be raised or lowered, may allow children and others to play basketball. Preferably, the support pole is telescopically adjustable to allow the height of the goal to be adjusted.

Still another aspect is basketball goal system in which the backboard may be supported by two support arms. In particular, the two support arms are preferably disposed near the upper portion of the support pole and the two support arms desirably curve outwardly and away from each other. The support arms may also include a lower portion that is connected to a lower portion of the backboard, a middle portion that is connected to the support pole, and an upper portion that is connected to the backboard. The lower portion of the support arms, however, does not have to be connected to the backboard. Preferably, the upper portions of the support arms are connected to an upper portion of an H-shaped interior support of the backboard. Advantageously, the support arms allow for a highly distributed four point connection of the backboard to the support pole.

Another aspect is a basketball goal system in which the basketball rim or hoop assembly may be connected to the lower portion of the support arms. Desirably, the hoop assembly is pivotally connected to the support arms and the hoop assembly may be configured to pivot downwardly in response to a force or load greater than a predetermined amount being exerted on the rim. In particular, the hoop assembly may be configured to allow the rim or front portion of the hoop assembly to tilt downwardly and the rear portion of the hoop assembly may tilt upwardly when a force that exceeds the set amount is placed on the rim.

Advantageously, the basketball goal system has a relatively straightforward, uncomplicated design that is aesthetically pleasing. The basketball goal system may also be cost effective because it has few components that can be easily assembled. In addition, the basketball goal system may be easy to manufacture because it has easy access to the various components and none of the components are located in a confined area. Further, the basketball goal system should be simple to maintain, repair and replace. Finally, the basketball goal system can be used with basketball systems that are adjustable in height, and basketball systems that are permanently held in a fixed location or portable basketball systems.

A further aspect is a basketball backboard for a basketball goal system with mass or weight added to desired portions of the backboard in order to enhance the rebounding characteristics of the backboard. The additional weight may enhance the rebounding characteristics of the backboard because the basketball may rebound in a more uniform and consistent manner. In particular, the extra weight may help prevent the backboard from undesirably moving and/or deflecting when the basketball strikes the backboard and that may cause the basketball to rebound in a more reliable and dependable fashion. Advantageously, the additional mass or weight may be selectively or permanently attached to the backboard.

Another aspect is a basketball backboard for a basketball goal system with additional mass or weight added to the perimeter or outer portions of the backboard. In particular, mass or weight may be added to the edges or other desired portions of the backboard to create an at least partially perimeter-weighted backboard. In addition, the added mass or weight may be positioned away from the structure pole and/or support arms that are used to support the basketball backboard. Desirably, the added mass or weight is positioned near the perimeter of the backboard and away from the support structure, but the positioning of the added mass or weight may depend, for example, upon the shape and configuration of the backboard and/or support structure. Advantageously, the additional mass or weight may create a more uniform and predictable rebounding of the basketball because the additional weight may help prevent the backboard from undesirably moving and/or deflecting when struck by a basketball.

Another aspect is a basketball backboard for a basketball goal system that may be at least partially constructed from generally lightweight materials, such blow-molded plastic. Advantageously, a lightweight basketball backboard may be easily transported and shipped. The lightweight backboard may also allow the basketball goal system to be relatively easily constructed and assembled. In addition, the lightweight backboard may not require a large support structure to hold the backboard above the playing surface.

A still further aspect is a basketball backboard for a basketball goal system that may be at least partially constructed from blow-molded plastic and the blow-molded plastic includes one or more depressions, "tack-offs" or "kiss-offs." The depressions may be formed in the backboard and/or the backboard frame, and the depressions are desirably sized and configured to increase the strength and rigidity of the backboard. The depressions preferably extend from one surface and contact or engage an opposing surface, but the depressions do not have to contact or engage the opposing surface. The depressions are desirably formed in the back or rear surface of the basketball backboard and/or frame so that the depressions are generally not visible while playing the game of basketball. The depressions, however, may also be formed in the front surface of the basketball backboard and/or frame. In addition, one or more depressions may be formed in the rear surface of the frame and one or more depressions may be formed in the front surface of the frame, and these opposing depressions may be generally aligned. At least a portion of these opposing depressions preferably contract or engage each other, but the opposing depressions do not have touch or engage. Further, one or more depressions may be located on one surface of the frame or backboard and one or more depressions may be located in an opposing surface of the frame or backboard.

Advantageously, a basketball backboard that is at least partially constructed from blow-molded plastic may be relatively strong because it includes two or more opposing walls or surfaces that are separated by a given distance. The opposing walls help create a high-strength, rigid basketball backboard and the backboard may be relatively lightweight because the interior portion of the backboard between the opposing walls may be hollow. Significantly, the strong and sturdy basketball backboard can withstand repeated impacts with a basketball or other similar objects.

Significantly, a basketball backboard that is at least partially constructed from blow-molded plastic can be quickly and easily manufactured. In particular, the blow-molding process allows the double walls and one or more depressions to be quickly and easily formed. As discussed above, the double walls and depressions allow a strong and sturdy backboard to be constructed. These and other features also allow the basketball backboard to be constructed with relatively thin plastic walls and that reduces the amount of materials required to construct the backboard. This also reduces the weight of the backboard, which saves manufacturing costs and decreases the amount of resources used to construct the backboard. The thin walls also allow the backboard to be cooled more quickly during the manufacturing process, and that saves additional time and further decreases costs.

A further aspect is a basketball backboard for a basketball goal assembly that includes a metal frame and a rebound member that is attached to the frame. Advantageously, the metal frame may securely support the rebound member and the rebound member is desirably constructed from plastic such as Lexan® which allows a generally transparent or clear backboard to be created.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

The present invention is generally directed towards a basketball goal system. The principles of the present invention, however, are not limited to basketball goal systems. It will be understood that, in light of the present disclosure, the basketball goal system disclosed herein can be successfully used in connection with other types of sporting equipment.

Additionally, to assist in the description of the basketball goal system, words such as top, bottom, front, rear, right and left are used to describe the accompanying figures. It will be appreciated, however, that the basketball goal system can be located in a variety of desired positions—including various angles, sideways and even upside down. A detailed description of the basketball goal system now follows.

Figure 1:
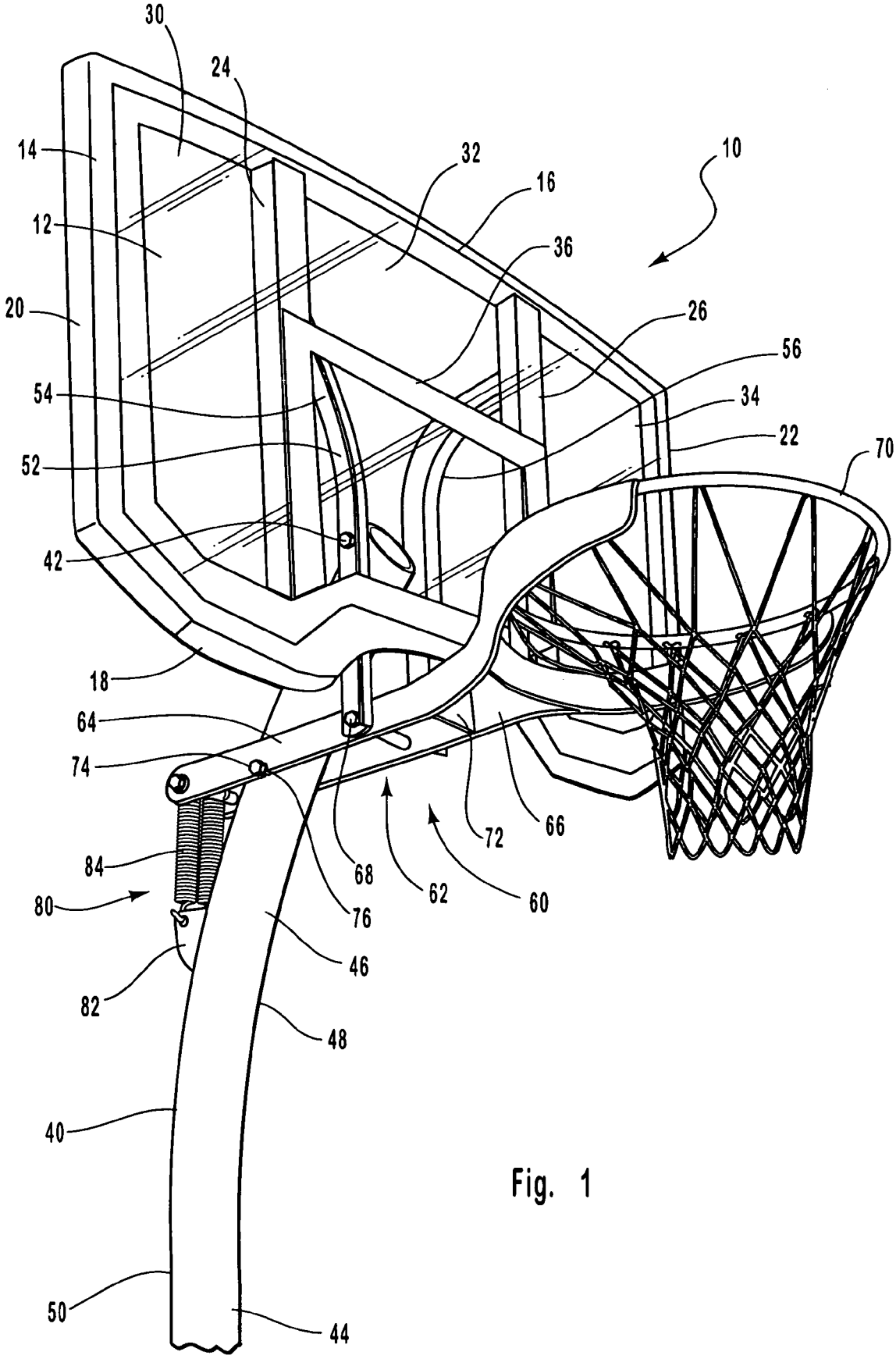
FIG. 1 is a perspective view of a portion of an embodiment of a basketball goal system, illustrating a backboard and rim assembly.

As seen in FIG. 1, the basketball goal system 10 includes a backboard 12 with a rebound member 13 and a support frame 14. The rebound member 13 preferably has a generally smooth, planar outer surface so that a basketball bounces or rebounds off the backboard in a consistent manner. The rebound member 13 is preferably constructed from plastic and, in particular, from an acrylic sheet that has sufficient thickness so that it will not break during a game of basketball. The rebound member 13 is preferably constructed from an acrylic sheet because it is lightweight, easy to manufacture, and allows the basketball goal system 10 to be easily assembled. In addition, the rebound member 13 is preferably constructed from acrylic or other suitable clear, transparent or generally translucent materials so that light can pass through the backboard. This creates basketball goal systems 10 that are similar in appearance and characteristics to that used in professional and major college games. One skilled in the art, however, will realize that the backboard 12 can be constructed from any suitable materials and the backboard can be constructed from opaque or other types of solid materials.

The basketball backboard support frame 14 is preferably constructed from a lightweight material, such as plastic. Desirably, the support frame 14 is constructed from blow-molded plastic to create a strong, lightweight and durable frame. In greater detail, the support frame 14 is preferably constructed using a blow-molded plastic process, and the frame includes two opposing walls or surfaces that are separated by a given distance in order to create a strong and sturdy structure. In addition, the interior portion of the blow-molded support frame 14 is preferably generally hollow. Advantageously, this creates a support frame 14 that is lightweight, strong and rigid, which allows it to withstand repeated impacts with a basketball or other similar objects. The support frame 14 may include one or more "tack offs," or depressions in order to further strengthen the frame. Various embodiments of depressions and other features that may be used in conjunction with the backboard 12 are disclosed in Assignee's copending U.S. patent application Ser. No. 10/352,940, entitled Blow-molded Basketball Backboard Frame, which is hereby incorporated by reference in its entirety.

The basketball backboard support frame 14 is preferably constructed from blow-molded plastic because it can easily be formed into any desired size and configuration. The support frame 14 is also desirably constructed from blow-molded plastic because it is durable, weather resistant and generally temperature insensitive. In particular, the support frame 14 generally does not corrode, rust or otherwise deteriorate over time if it is constructed from blow-molded plastic.

The support frame 14 is preferably constructed from blow-molded plastic because weight reduction of the basketball goal system 10 may be highly desirable. For example, constructing the support frame 14 from lightweight, blow-molded plastic may decrease shipping costs, whether shipping the system from the manufacturer to a retailer or consumer. The blow-molded basketball frame 14 may also allow for the overall weight of the basketball goal system 10 to be decreased. The lightweight backboard support frame 14 may also simplify the attachment of the basketball goal system 10 to the support pole or other support structures because the lighter weight goal system may be easier to manipulate and control during the assembly process. One skilled in the art will understand that the basketball frame 14 may also be constructed from injection molded plastic, extrusion molded plastic, and the like. Further, as discussed in further detail below, the frame may be constructed from other materials with suitable characteristics such as metal.

The basketball backboard support frame 14 is preferably constructed as a unitary, one-piece structure. Advantageously, this may further decrease manufacturing costs and time because two or more components do not have to be assembled or fastened together. In addition, the one-piece structure may allow a strong and sturdy support frame 14 to be manufactured. It will be appreciated that the support frame 14, however, may be constructed by one or more components that are connected together by any suitable means such as fasteners and/or adhesives.

As shown in FIGS. 1 to 4, the basketball backboard support frame 14 has an outer periphery or exterior with a top surface 16, a bottom surface 18, a left side 20 and a right side 22. As shown in the accompanying figures, the outer edges of the frame 14 are curved, rounded or arched, but it will be appreciated that the frame can have any suitable design and configuration, such as rectangular, depending, for example, upon the intended use of the frame.

The support frame 14 may also includes two support arms 24, 26 disposed between the outer edges or periphery of the frame. The support arms 24, 26 preferably extend vertically and are generally parallel to each other, but one skilled in the art will recognize that the support arms 24, 26 can have any suitable size and configuration depending, for example, upon the intended use of the frame 14.

Figure 2:
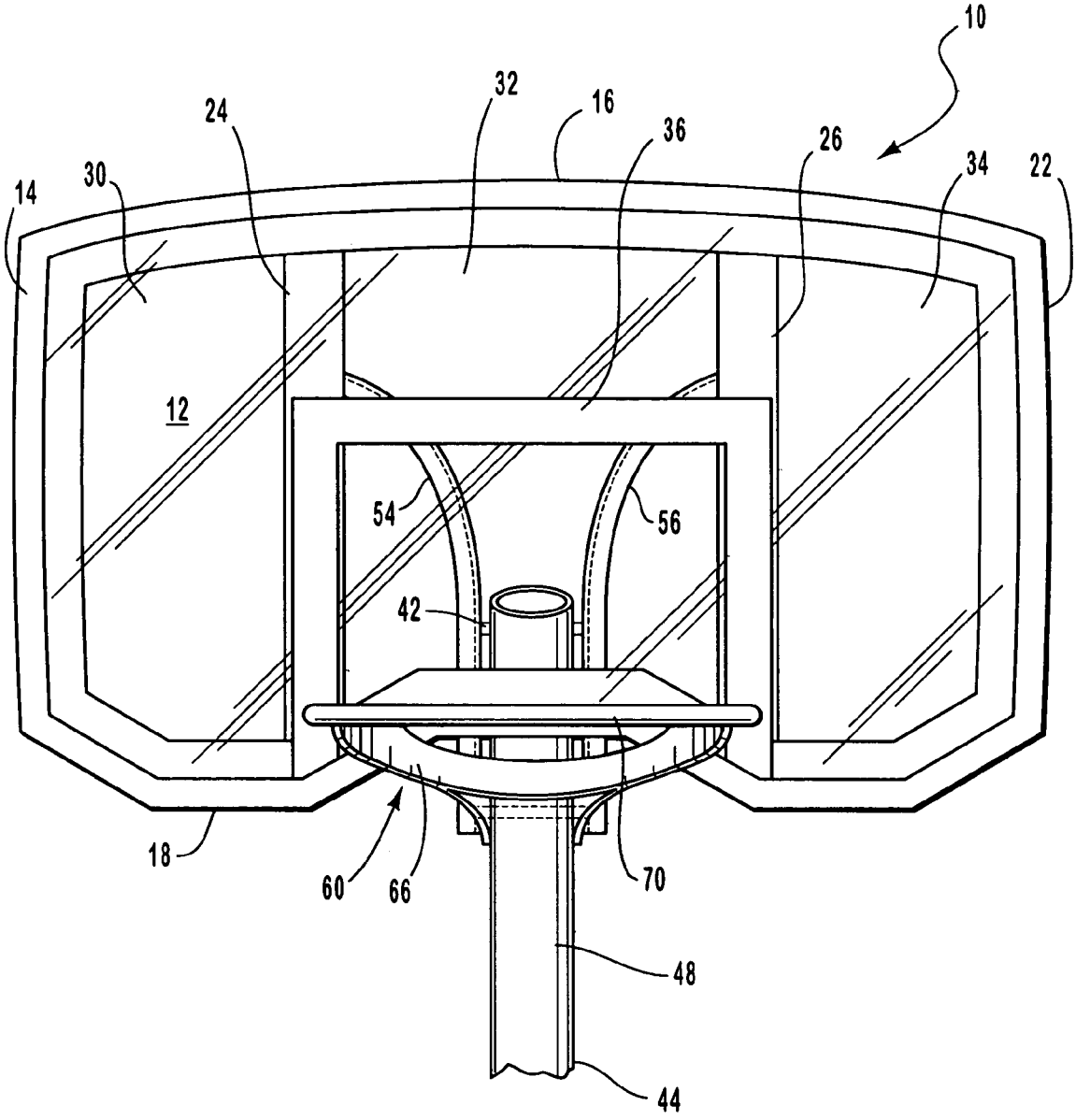
FIG. 2 is a front view of a portion of the basketball goal system shown in FIG. 1.

As best seen in FIGS. 1 and 2, the support arms 24, 26 desirably divide the frame 14 into three distinctive openings or sections 30, 32, and 34. Advantageously, the support arms 24, 26 and the outer edges of the frame 14 securely support the rebound member 13 such that a basketball rebounding from the backboard will deflect the backboard a minimal amount. This creates a backboard 12 with very good rebounding characteristics. Desirably, the rebounding characteristics of the basketball goal system 10 are generally similar to the rebounding characteristics of a one-piece, generally solid backboard. The large openings 30, 32 and 34, however, allow a lightweight basketball goal system 10 to be created. The large openings 30, 32 and 34 also allow a generally see-through basketball backboard 12 to be created, if desired. In addition, the support arms 24, 26 may create a high-quality, professional appearance for the basketball goal system 10.

The support arms 24, 26 are preferably sized and configured such that a basketball target 36 covers or hides at least a portion of the support arms. For example, as best seen in FIG. 1, the basketball target 36 has a generally rectangular configuration and it is generally positioned above the basketball goal. As known to those skilled in the art, the basketball target 36 is used to provide a reference for shooting and rebounding a basketball from the backboard 12. Because the target 36 is present on most backboards 12, it can be used to hide portions of the support arms 24, 26 from view. Desirably, the target 36 covers at least a lower portion of the first and second support arms 24, 26. This creates the appearance that the backboard 12 is only supported by the frame 14 and the upper portions of the first and second support arms 24, 26. It will be appreciated, however, that the support arms 24, 26 can have any suitable size and configuration depending upon the intended use of the basketball goal system 10. For example, the upper portions of the first and second lateral support members 42, 44 can be curved, angled or have other desired shapes for aesthetic or functional purposes. In addition, the support frame 14 may include only one support arm or more than two support arms. One skilled in the art will also appreciate that the other suitable structures and designs may be used to support the backboard 12 and/or rebound member 13.

Figure 3:
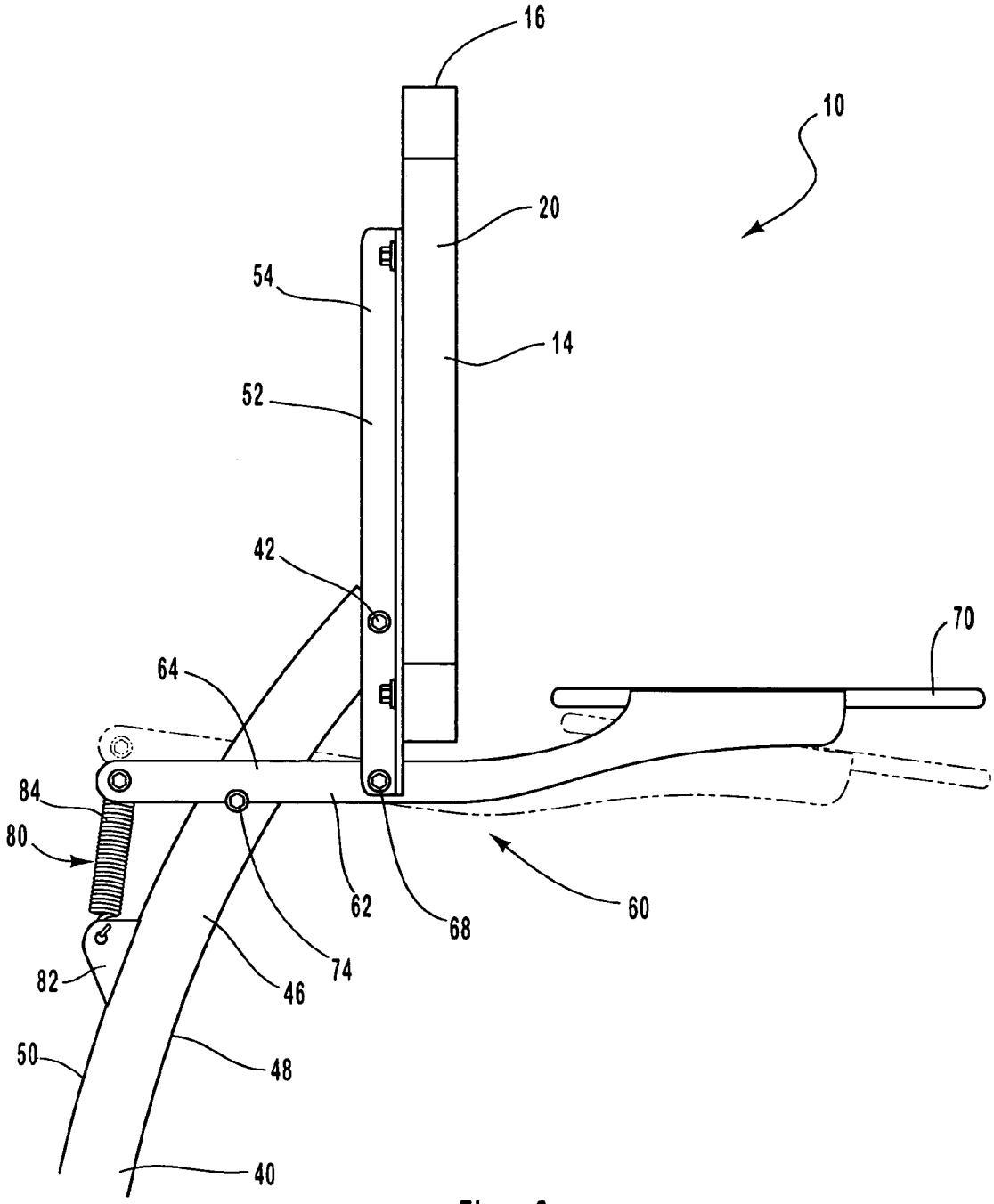
FIG. 3 is a side view of a portion of the basketball goal system shown in FIG. 1, illustrating the rim assembly in a first position in which the rim is generally perpendicular to the backboard and a second position in which the rim is tilted downwardly.
Figure 4:
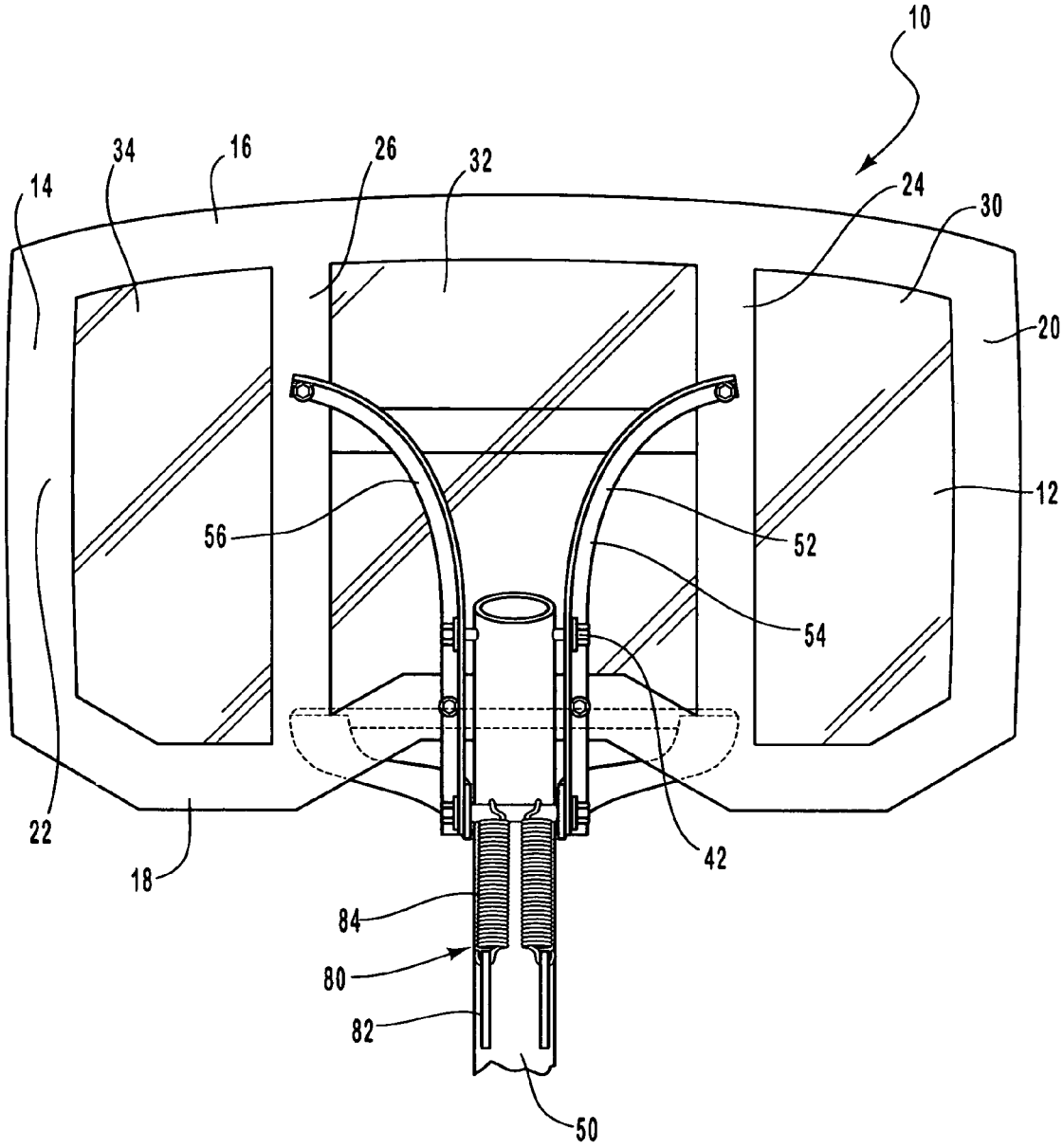
FIG. 4 is a rear view of a portion of the basketball goal system shown in FIG. 1.
Figure 5:
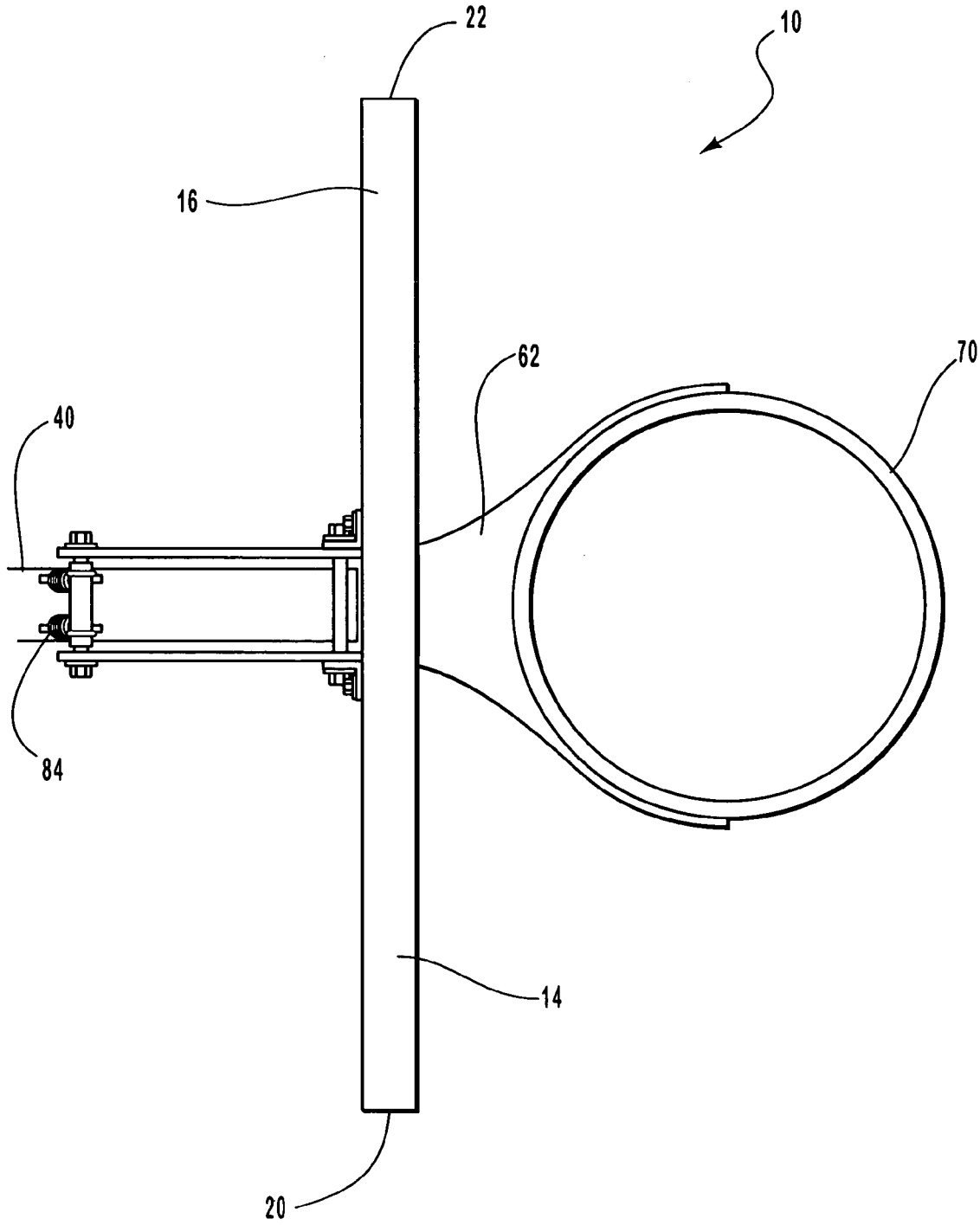
FIG. 5 is a top view of a portion of the basketball goal system shown in FIG. 1.
Figure 10:
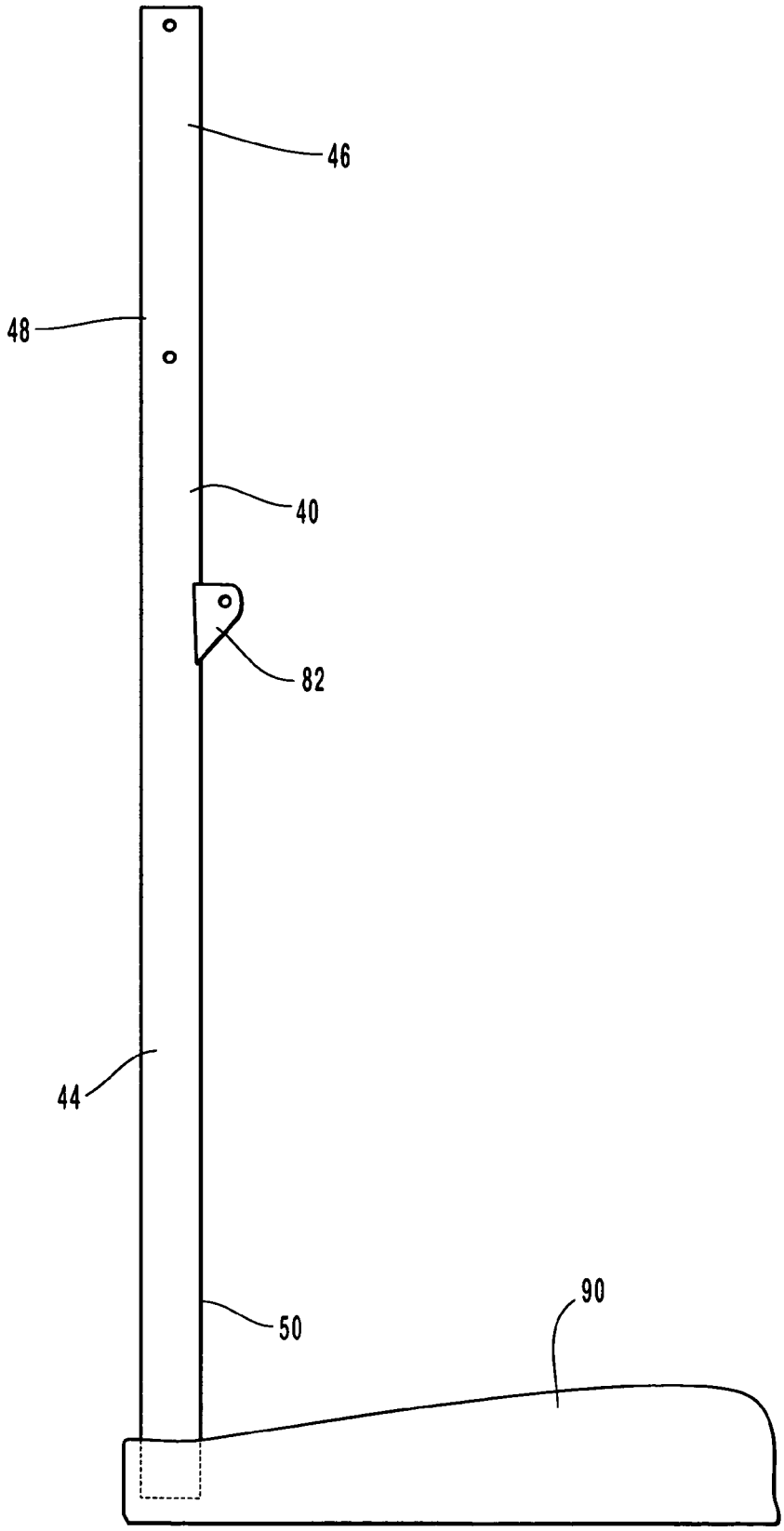
FIG. 10 is a side view of a portion of yet another embodiment of the basketball goal system, illustrating a support pole and portable base.
Figure 11:
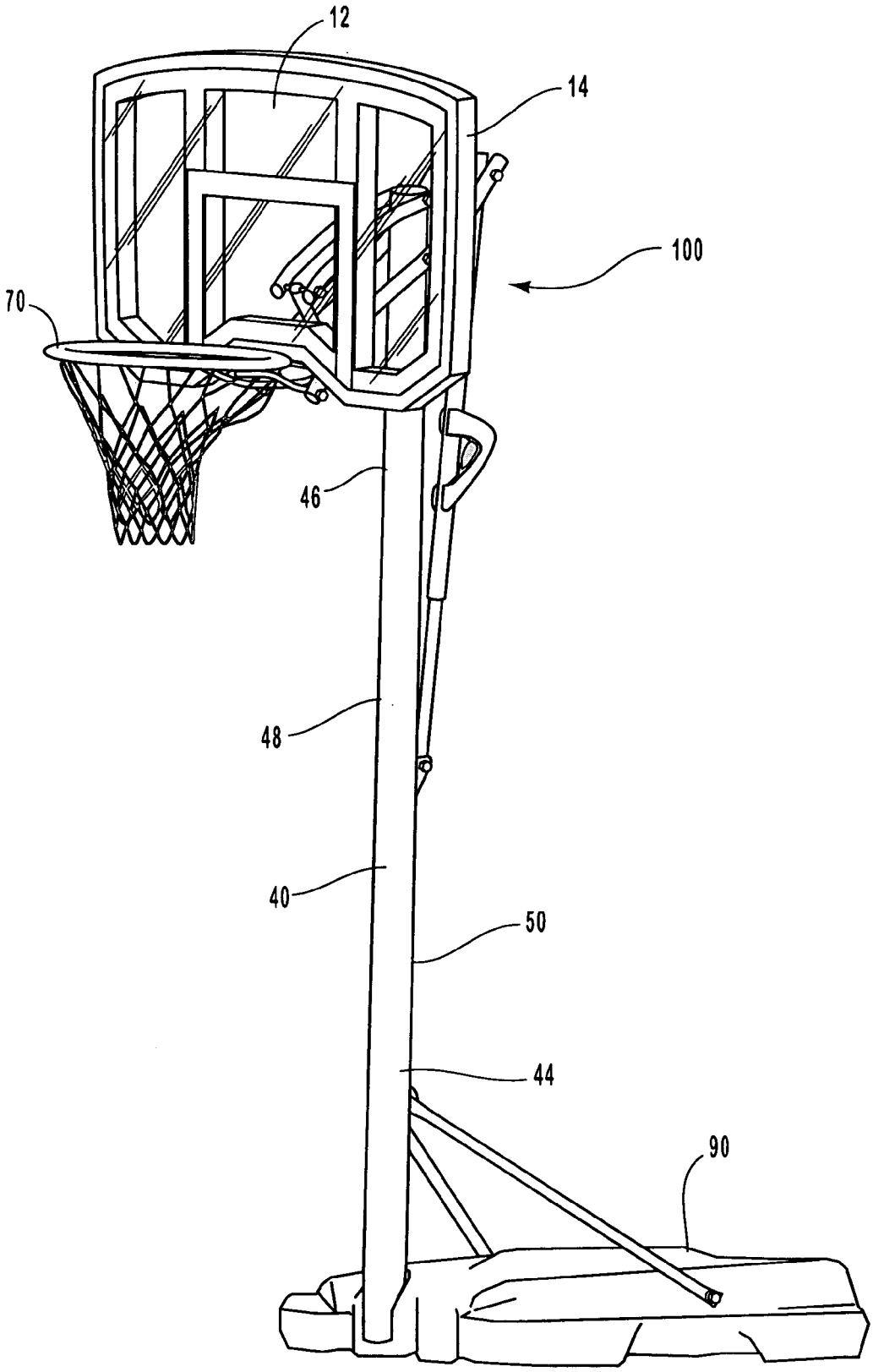
FIG. 11 is a perspective view of still another embodiment of the basketball goal system, illustrating a portable basketball goal system and an adjustable height basketball goal assembly.
Figure 12:
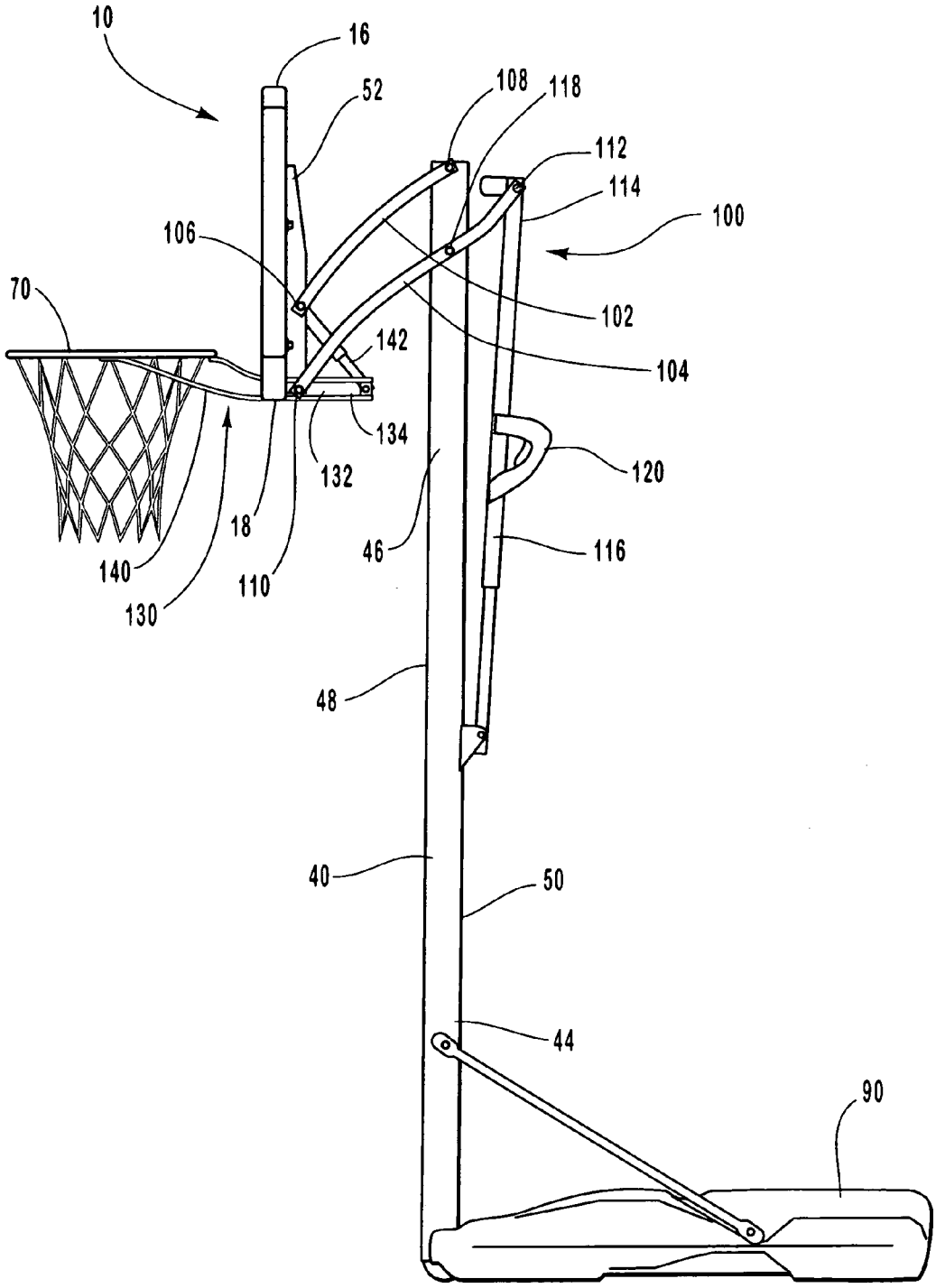
FIG. 12 is a side view of yet another embodiment of the basketball goal system, illustrating a portable basketball goal system and an adjustable height basketball goal assembly.
Figure 13:
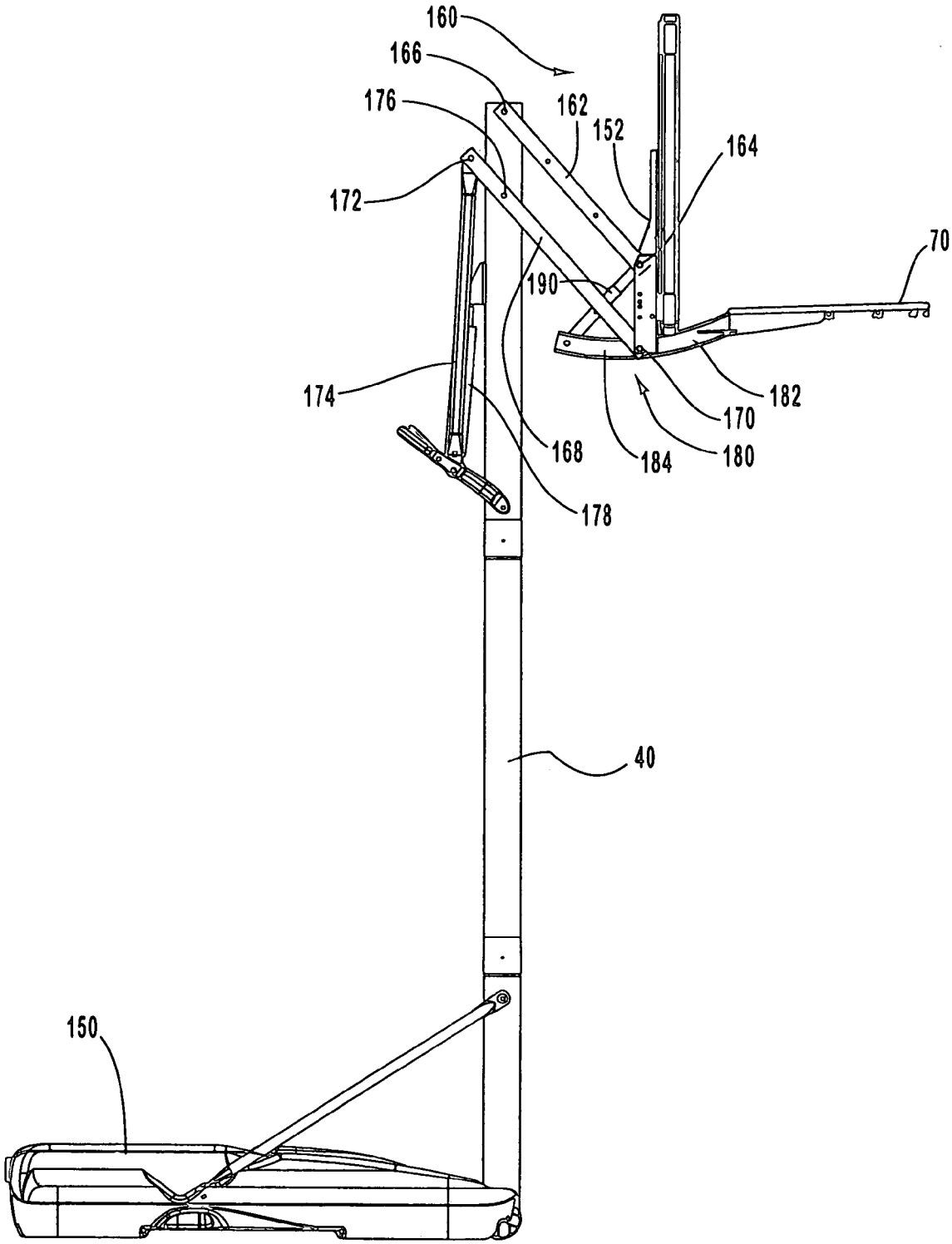
FIG. 13 is a side view of a further another embodiment of a basketball goal system, illustrating a portable basketball goal system and an adjustable height basketball goal assembly.

As shown in FIGS. 1 and 3, the support frame 14 for the backboard 12 is connected to a support structure such as a pole 40. The support frame 14 is preferably connected to the support pole 40 by one or more fasteners 42 such as bolts or screws. As shown in the accompanying figures, a lower portion 44 of the pole 40 is preferably generally vertically positioned and an upper portion 46 of the pole may extend or cantilever generally forwardly. Advantageously, the forwardly extending pole is preferably sized and configured so that the pole does not interfere with the basketball game. For example, the pole 40 may be curved such that the lower portion 44 of the pole is positioned outside of the playing area of the game and the upper portion 46 of the support pole may position the backboard 12 and rim assembly inside the playing area of the game, but it will be appreciated that the pole 40 can have any desired configuration including, for example, a generally vertical configuration as shown in FIGS. 10–12. The pole 40 may also include a front surface 48 that is disposed towards the playing surface and a rear surface 50 that is disposed away from the playing surface.

The basketball backboard 12 and support frame 14 are connected to the upper portion 46 of the pole 40 by a backboard support assembly 52 that includes two generally upwardly extending support arms 54 and 56. The upper portions of the support arms 54, 56 preferably curve outwardly, but the size and shape of the support arms may depend, for example, upon the configuration of the support frame 14. In greater detail, the upper portions of the support arms 54, 56 preferably extend outwardly and are preferably securely connected to the support arms 24, 26 of the frame 14. A first intermediate portion of each support arm 54, 56 may be connected to the upper portion 46 of the support pole 40 and a second intermediate portion of each support arm may be connected to a lower portion of the support frame 14. The connection of the support arms 54, 56 to two different locations of the frame 14 allows the backboard 12 to be securely connected to the backboard support assembly 52. Additionally, the connection of the backboard support assembly 52 to the pole 40 allows the backboard 12 to be securely supported above the playing surface. One skilled in the art will appreciate that the backboard support assembly 52 can have other suitable configurations depending, for example, upon the size and shape of the frame 14 and/or pole 40. In addition, the connection of the backboard support assembly 52 to the pole 40 and frame 14 can use any suitable type of connection, including suitable fasteners, adhesives, and the like, and the connections may also be rotatable or pivotal if desired.

The support arms 54, 56 of the backboard support assembly 52 preferably extend below the bottom portion of the backboard 12 and are sized and configured to be connected to the goal support assembly 60. In particular, the support arms 54, 56 include lower ends that are connected to an elongated support member 62 of the goal support assembly 60. The elongated support member 62 preferably comprises two generally parallel arms 64, 66 that are connected to the lower ends of the support arms 54, 56 by a fastener such as a bolt 68. Because the support arms 54, 56 are disposed behind the plane of the backboard 12, the connection of the goal support assembly 60 to the backboard support assembly 52 is also disposed behind the plane of the backboard. It will be appreciated, however, that the connection of the goal support assembly 60 to the backboard support assembly 52 could also be below or in front of the backboard 12.

The hoop or rim 70 is attached to a front portion of the goal support assembly 60. In particular, the parallel arms 64, 66 are preferably attached to different sides of the hoop 70, but it will be appreciated that the hoop can be attached to the goal support assembly 60 by any suitable manner. The front portion of the goal support assembly 60 may also include one or more connecting members 72 that may be configured to maintain the arms 64, 66 in their desired position.

The goal support assembly 60 is preferably movable in order to create a breakaway basketball rim. In particular, the goal support assembly 60 is desirably pivotally connected to the lower portion of the support arms 54, 56 of the backboard support assembly 52 to allow pivotal movement of the hoop 70. Advantageously, because the goal support assembly 60 is attached to the backboard support assembly 52 and not the backboard 12, forces caused by players contacting the rim are not directly transmitted to the backboard, which prevents damage of the backboard. Additionally, because the goal support assembly 60 is not connected to the backboard 12, no openings or slots must be formed in the backboard to allow attached of the goal support assembly to the backboard. This increases the structural integrity of the backboard 12.

As best seen in FIGS. 1 and 3, a stop 74 is located on one or both sides of the support pole 40. The stop 74 is preferably a bolt or fastener, but any suitable type of protruding member or structure may be used to form the stop. The stop 74 contacts the elongated support member 62 and it may be sized and configured to fit within an opening or cutout 76 in the elongated support member 62. The stop 74 is preferably positioned such that it contacts or engages the cutout 76 when the goal support assembly 60 is disposed horizontal to the playing surface. The stop 74 and cutout 76 are also preferably sized and configured to allow the goal support assembly 60 to pivot or move to create a breakaway basketball rim. It will be appreciated, however, that the goal support assembly 60 may be rigidly attached to the support pole 40 to form a conventional, non-movable basketball rim, if desired. It will also be appreciated that other suitable means, such as a detent mechanism or frictional engagement, may be used to control the positioning of the goal support structure.

Figure 6:
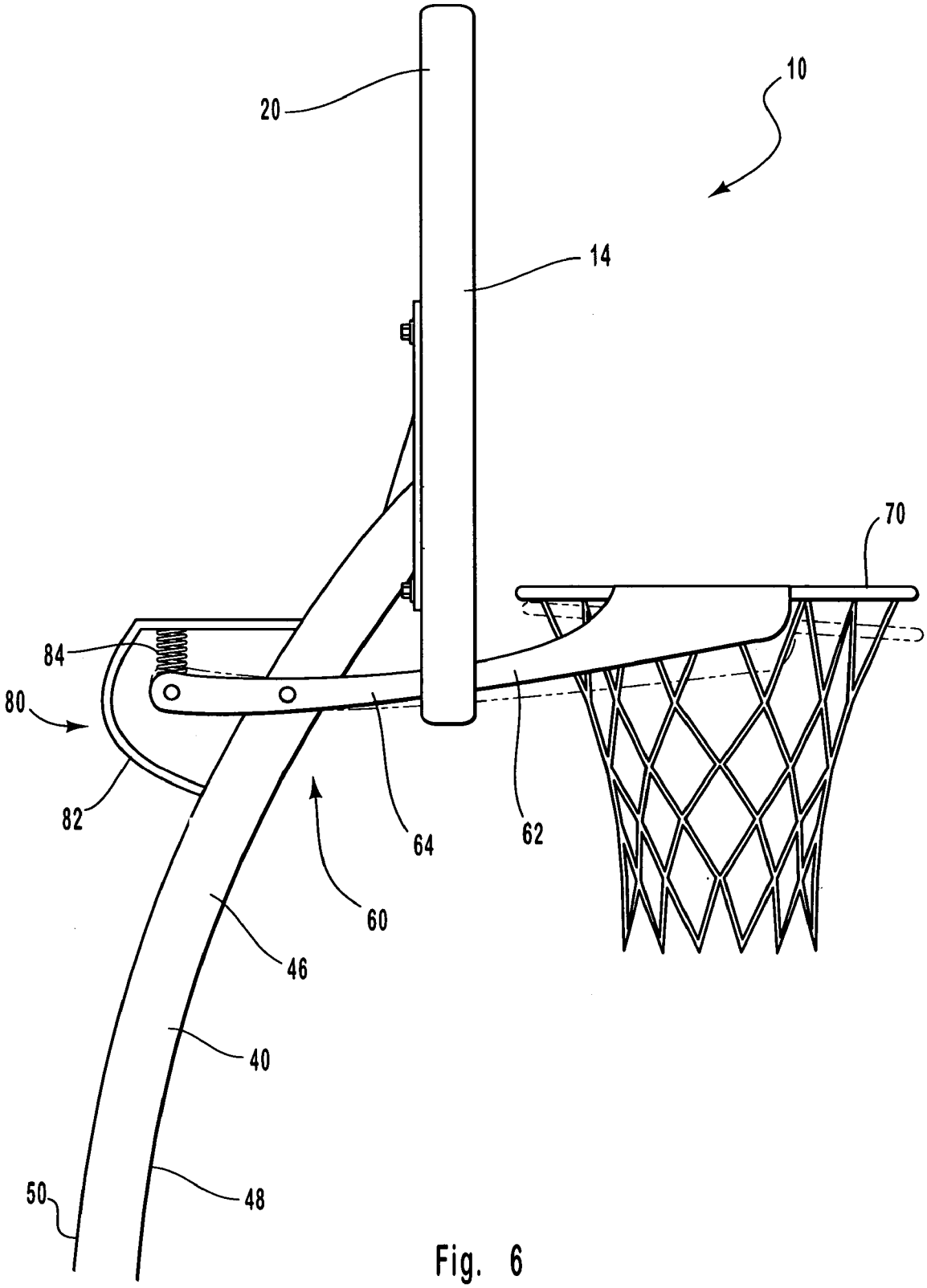
FIG. 6 is a side view of a portion of another embodiment of the basketball goal system, illustrating a backboard and rim assembly.
Figure 7:
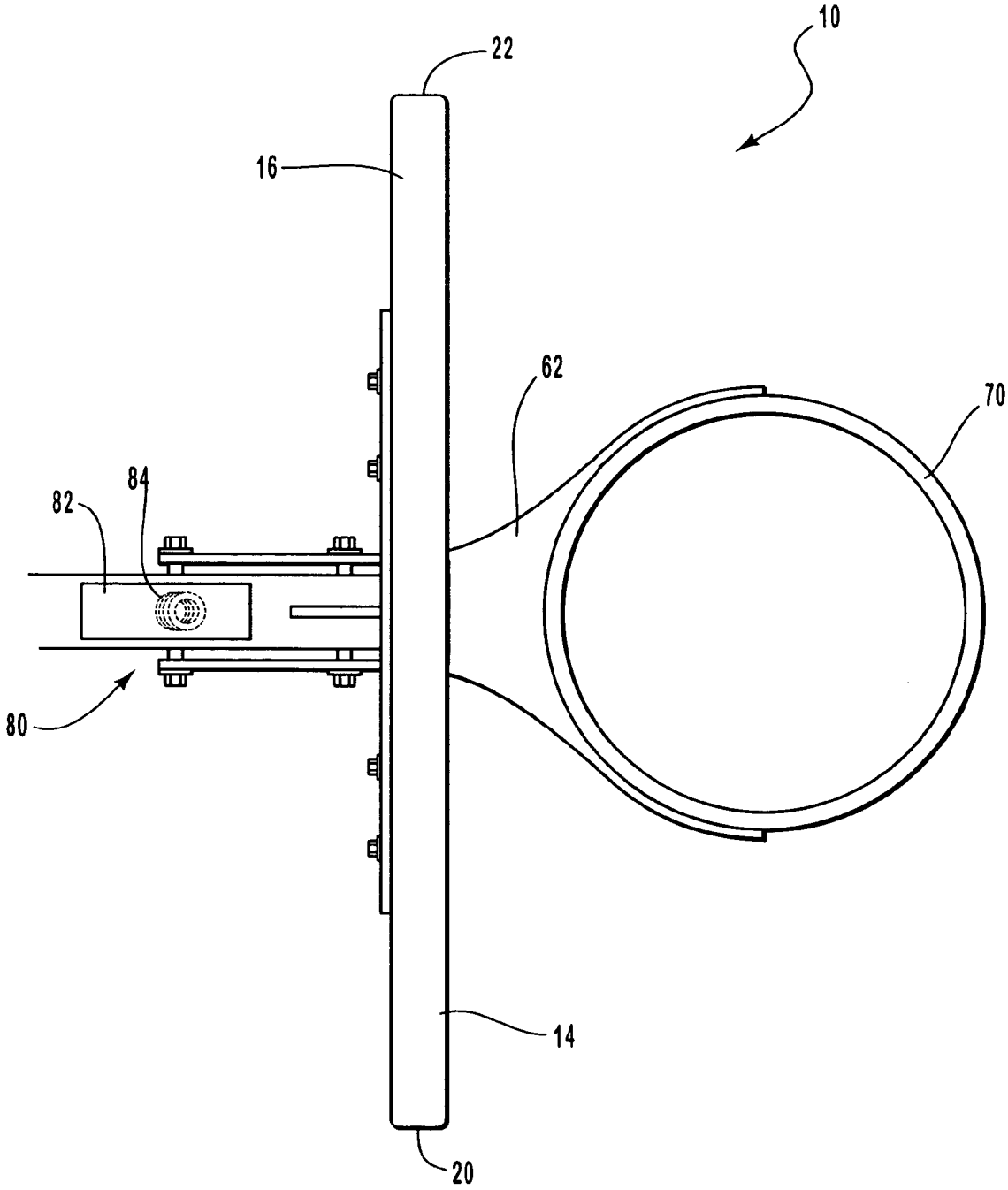
FIG. 7 is a top view of a portion of the basketball goal system shown in FIG. 6.

A resistance mechanism 80 is attached to the end of the elongated support member 62 of the goal support assembly 60. The resistance mechanism 80 is also attached to the rear surface 50 of the support pole 40 by a retaining assembly 82. The resistance mechanism 80 may include one or more springs 84 that allow the movement of the goal support assembly 60. The springs 84 are preferably coil springs, but any suitable type of springs may be utilized. The springs 84 preferably have a spring rate to allow movement of the elongated support member 62 when a force greater than a predetermined amount is applied to the rim 70. The resistance mechanism 80 then returns the rim to its normal position when the force to the rim is removed or decreased below the predetermined amount. One skilled in the art will understand that the resistance mechanism 80 may include any suitable type of flexible and/or elastic device or structure, such as a roller bearing and detent, that allows movement of the elongated support member 62. Additionally, one skilled in the art will understand that springs 84 may be in tension and/or compression depending upon the configuration of the resistance mechanism 80 and location of the retaining assembly 82. For example, as shown in FIGS. 1 to 5, the retaining assembly 82 is disposed below the ends of the support arms 64, 66 and the resistance mechanism 80 is located below the end of the elongated support member 62. On the other hand, as shown in FIG. 6, the retaining assembly 82 may be configured such that the resistance mechanism 80 is located above the ends of the support arms 64, 66. Thus, the retaining assembly 82 and resistance mechanism 80 may have various configurations and arrangements, and any suitable type of resistance mechanism and arrangement of components may be used depending, for example, upon the design and intended use of the basketball goal system 8.

The resistance mechanism 80 is preferably configured to maintain the rim 70 parallel to the playing surface and hold the rim in a rigid, secure position such that no unintended deflection or movement of the rim occurs during a basketball game. In this normal position, the rim 70 and elongated support ember 62 are preferably located in a horizontal position and the stop 74 engages the cutout 76. When a force or load larger than a prearranged amount impacts the rim 70, the resistance mechanism 80 allows momentary deflection of the rim downwardly towards the playing surface to help absorb the force or impact on the rim. Desirably, this downward movement of the rim 70 may help prevent injury to the players and damage to the rim. The resistance mechanism 80 preferably immediately returns the rim 70 to its normal position when the force is removed so that there is no delay in the basketball game. Advantageously, the breakaway rim assembly has few moving parts, which makes the assembly long-lasting, and it desirably has the feel and characteristics of a regulation, non-breakaway rim. The basketball goal system 10, however, a does not require the use of a breakaway rim assembly and a fixed or non-movable rim assembly may also be used.

As shown in the accompanying figures, the resistance mechanism 80 is preferably located behind the plane of the backboard 12 so that it does not interfere with playing the game of basketball. The pivotal connection of the goal support assembly 60 and the backboard support assembly 52 is also preferably located behind the plane of the backboard so that it is less likely to be contacted by a player. Additionally, locating at least a portion of the connection of the goal support assembly 60 to the backboard support assembly 52 and at least a portion of the resistance mechanism behind the plane of the backboard may create a pleasing aesthetic appearance and prevent these components from interfering with playing basketball. This may also form a relatively uncomplicated design and create a basketball goal assembly that is relatively easy to construct and assemble. The location of the resistance mechanism 80 also makes the basketball goal system 10 easy to install and simple to maintain. One skilled in the art will appreciate that the resistance mechanism 80 and retaining assembly 82 may also be located in other suitable locations and arrangements.

The resistance of the resistance mechanism 80 may also be adjustable to allow the rim 70 to deflect when a load or force greater than an adjustable amount is applied to the rim 70. This may allow the breakaway rim to be used by players of various sizes and abilities. For example, the resistance mechanism 80 may be adjusted to allow the rim assembly to move when a relatively small amount of force is applied to the rim when children or young adults are playing basketball. On the other hand, the resistance mechanism 80 may be adjusted to allow the rim assembly to move only when a relatively large amount of force is applied to the rim during competition or highly competitive games. In order to adjust the resistance of the resistance mechanism 80, a structure that allows the springs 84 to more freely expand or compress may be used. It will be appreciated that a variety of suitable devices and methods may be used to adjust the force in which the rim 70 releases or deflects.

Figure 8:
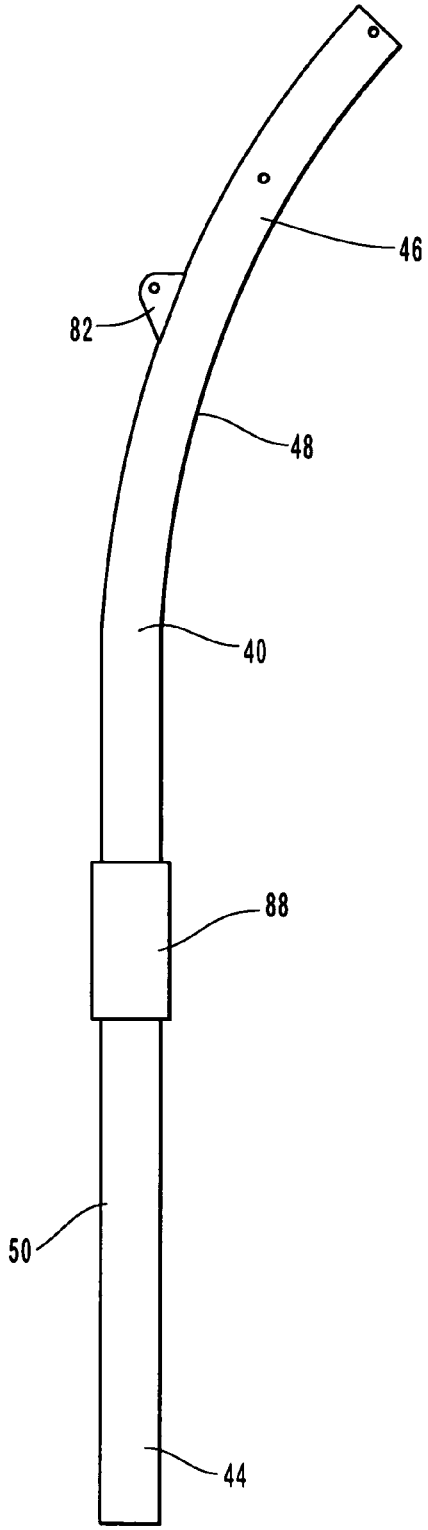
FIG. 8 is a side view of a portion of another embodiment of the basketball goal system, illustrating a support pole and a retaining member.
Figure 9:
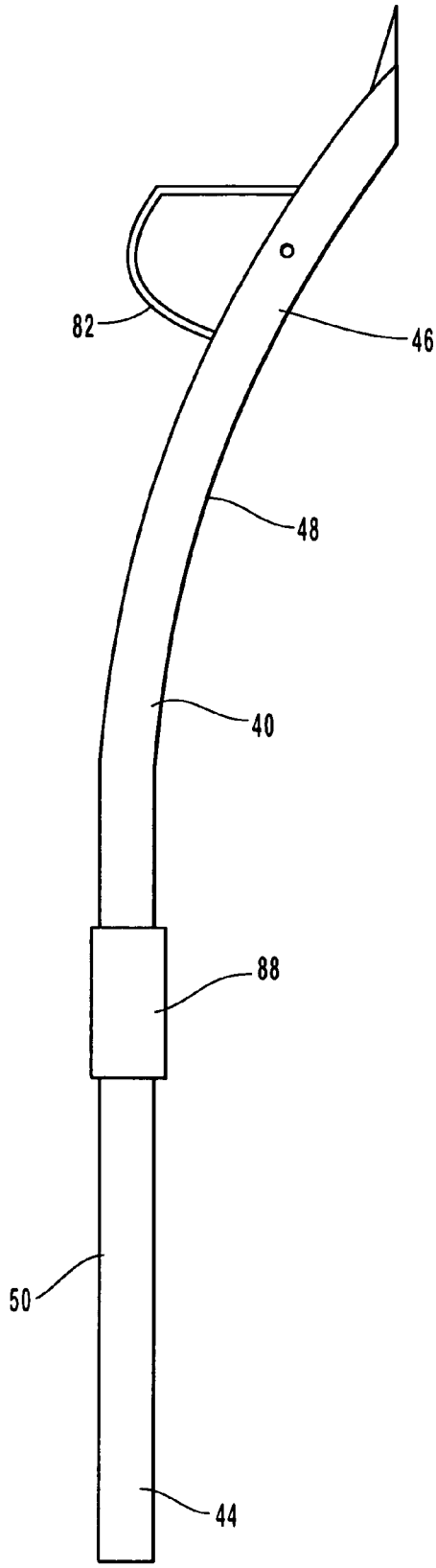
FIG. 9 is a side view of a portion of another embodiment of the basketball goal system, illustrating a support pole and a retaining member.

The basketball goal system 10 may also be adjustable in height. For example, as shown in FIGS. 8 and 9, the support pole 40 may include a telescoping portion 88 that allows the length of the pole to be adjusted. This allows the height of the backboard 12 and rim 70 to be adjusted with respect to the playing surface. It will be understood that the length of the support pole may be adjusted in a variety of suitable manners. For example, various embodiments of adjustable length support poles that may be used with the basketball goal system 10 are disclosed in Assignee's U.S. Pat. Nos. 5,375,835 and 5,573,237, which are incorporated by reference in their entireties. One skilled in the art will appreciate that other suitable methods may be used to adjust the length of the pole 40.

In addition, the basketball goal system 10 may be used in connection with basketball systems that are generally permanently installed in a fixed location, such as an in-ground basketball system, or portable basketball systems, such as illustrated in FIG. 10. For example, as shown in FIG. 10, the support pole 40 can be connected to a base 90 that can be filled with ballast such as sand or water to create a portable basketball system. The base 90 advantageously allows the basketball system to be positioned in a plurality of different locations. It will be appreciated that the basketball goal system 10 can be used with a variety of suitable fixed or portable basketball systems. For example, the basketball goal system 10 may be used with one of the portable basketball systems that are disclosed in Assignee's U.S. Pat. Nos. 5,836,838; 5,947,847; 6,027,418; and 6,432,003; and/or Assignee's copending U.S. patent application Ser. Nos. 10/212,443 and 10/050,612; which are incorporated by reference in their entireties.

As seen in FIGS. 11–12, the basketball goal system 10 can have other suitable configurations and arrangements. For example, as shown in the accompanying figures, a support structure 100 may be used to attach the backboard 12 and goal support assembly 130 to the support pole 40. The support structure 100 preferably includes an upper support member 102 and a lower support member 104, and these support members may be curved as shown in the accompanying figures. The upper support member 102 includes a first end 106 that is attached to the backboard support assembly 52 and a second end 108 that is attached to the support pole 40. The lower support member 104 includes a first end 110 that is attached to the backboard support assembly 52 and a second end 112 that is attached to an elongated member 114 that preferably forms a portion of a height adjustment mechanism 116. The lower support member 104 also includes a interior portion 118 that is attached to the support pole 40. Desirably, the upper and lower support members 102, 104 are pivotally attached to the backboard support assembly 52, support pole 40 and the height adjustment member 116 to allow the height of the backboard 12 and rim 70 to be adjusted. It will be appreciated, however, that the support structure 100, upper support member 102 and lower support member 104 can have other suitable configurations depending, for example, upon the size and configuration of the backboard 12, support frame 14 or support pole 40.

Advantageously, the support structure 100 allows the height of the backboard 12 and hoop 70 to be adjusted without changing the height of the pole 40, which may allow the basketball goal system 10 to be used by a wide variety of people. For example, the height of the basketball goal system 10 may be lowered to allow children to play and raised to allow adults to play. In addition, the upper and lower support members 102, 104 of the support structure are preferably positioned generally parallel to each other so that the face of the backboard 12 remains generally perpendicular to the playing surface while the height of the backboard 12 and hoop 70 are adjusted. Further, the height adjustment mechanism 116 may include a handle 120 that may be used to adjust the height of the basketball goal system 10.

Because the height adjustment mechanism 116 is attached to the support structure 100, movement of the height adjustment mechanism allows the height of the backboard 12 and rim 70 to be adjusted. In particular, the length of the elongated member 114 may be increased or decreased, for example, by a telescoping mechanism. As the length of the elongated member 114 is increased, that may cause the height of the backboard 12 and rim 70 relative to the playing surface to be decreased. On the other hand, when the length of the elongated member 114 is decreased, that may cause the height of the backboard 12 and rim 70 to be increased relative to the playing surface. One skilled in the art will appreciate that the support structure 100 and the height adjustment mechanism 116 may have other suitable configurations and arrangements, such as disclosed in Assignee's U.S. Pat. Nos. 4,781,375; 4,805,904; 5,324,027; 4,881,734; 5,695,417; 5,879,247; 6,077,177; 6,120,396; 6,273,834; 6,422,957; 6,142,891; 6,419,598; 6,155,938; 6,419,597; or 6,402,644; all of which are incorporated by reference in their entireties.

As best seen in FIG. 12, the basketball goal system 10 can also have other suitable arrangements and configurations, such as a goal support assembly 130 that is connected to the support arms 54, 56 of the backboard support assembly 52. In particular, the support arms 54, 56 include lower ends that are connected to an elongated support member 132 of the goal support assembly 130. The elongated support member 132 preferably includes two generally parallel arms 134, 136 that are connected to the lower ends of the support arms 54, 56 by a fastener such as a bolt 138. Because the support arms 54, 56 are disposed behind the plane of the backboard 12, the connection of the goal support assembly 130 to the backboard support assembly 52 is also disposed behind the plane of the backboard. It will be appreciated, however, that the connection of the goal support assembly 130 to the backboard support assembly 52 could also be below or in front of the backboard 12. It will also be appreciated that the elongated support member 132 does not require two arms 134, 136 and, in contrast, may have other suitable configurations such as a single arm or multiple arms.

The hoop or rim 70 is attached to a front portion of the goal support assembly 130. In particular, the parallel arms 134, 136 are preferably attached to different sides of the hoop 70 and one or more flanges 140 or connecting members may be used to connect the hoop to the goal support assembly. Advantageously, this creates a rigid and secure connection of the hoop to the goal support assembly. One skilled in the art will appreciate, however, that the hoop can be attached to the goal support assembly 130 in a variety of suitable manners or methods. In addition, one skilled in the art will appreciate that the goal support assembly 130 may consist of a single, integral component or the goal support assembly may consist of multiple components that are connected together.

The goal support assembly 130 is preferably movable in order to create a breakaway basketball rim. In particular, the goal support assembly 130 is desirably pivotally connected to the lower portion of the support arms 54, 56 of the backboard support assembly 52 to allow pivotal movement of the hoop 70. Advantageously, because the goal support assembly 130 is attached to the backboard support assembly 52 and not the backboard 12, forces caused by players contacting the rim are not directly transmitted to the backboard, which helps prevent damage to the backboard. Additionally, because the goal support assembly 130 is not directly connected to the backboard 12, no openings or slots must be formed in the backboard to allow attached of the goal support assembly to the backboard, which may increase the structural integrity of the backboard.

A resistance mechanism 142 is attached to the end of the elongated support member 132 of the goal support assembly 130. As shown in FIG. 12, the end of the elongated support member 132 does not have to extend beyond the support pole, but the end of the elongated support member could extend beyond the support pole. The resistance mechanism 142 is also attached to the backboard support assembly 52 and/or the support structure 100. Preferably, the resistance mechanism 142 is attached to both the backboard support assembly 52 and the upper support member 102 of the support structure 100. More preferably, the resistance mechanism 142 is attached to the connection of the upper support member 102 to the backboard support assembly 52. Desirably, this allows the same fastener or fasteners to connect the backboard support assembly 52, support structure 100 and resistance mechanism. One skilled in the art will appreciate that the resistance mechanism may be connected to any suitable portion of the backboard 12, backboard support assembly 52 and/or support structure 100 depending, for example, upon the configuration of the backboard, backboard support assembly and/or support structure.

The resistance mechanism 142 may include one or more shock absorbers, springs, pistons, or the like to control the movement of the goal support assembly 130. For example, the resistance mechanism 142 may include one or more coil springs, but any suitable type of springs may be utilized. The resistance mechanism 142 is preferably sized and configured to allow the goal support assembly 130 and rim 70 to move when a force greater than a predetermined amount is applied to the rim. The resistance mechanism 142 is also preferably sized and configured to return the rim 70 to its normal position when the force on the rim is removed or decreased below the predetermined amount. One skilled in the art will understand that the resistance mechanism 142 may include any suitable type of flexible and/or elastic devices or structures, such as a roller bearing and detent, that allows movement of the goal support assembly 130.

The resistance mechanism 142 is preferably configured to maintain the rim 70 parallel to the playing surface and to hold the rim in a rigid, secure position such that no unintended deflection or movement of the rim occurs while playing basketball. In this normal position, the rim 70 and elongated support member 132 are preferably located in a generally horizontal position. When a force or load larger than the preset amount impacts the rim 70, the resistance mechanism 142 allows momentary deflection of the rim downwardly towards the playing surface to help absorb the force or impact on the rim. Desirably, this downward movement of the rim 70 may help prevent injury to the players and damage to the rim. The resistance mechanism 142 preferably immediately returns the rim 70 to its normal position when the force is removed so that there is no delay in the basketball game. Advantageously, the breakaway rim assembly has few moving parts, which makes the assembly long-lasting, and it desirably has the feel and characteristics of a regulation, non-breakaway rim. As discussed above, the basketball goal system 10 does not require the use of a breakaway rim and a fixed or non-movable rim may also be used.

As shown in FIGS. 11 and 12, the resistance mechanism 142 is preferably located behind the plane of the backboard 12 so that it does not interfere with playing the game of basketball. In addition, the pivotal connection of the goal support assembly 130 and the backboard support assembly 52 is preferably located behind the plane of the backboard so that it is less likely to be contacted by a player. Advantageously, this may create a basketball goal system with a pleasing aesthetic appearance and an assembly that is relatively easy to construct and assemble. The location of the resistance mechanism 142 also makes the basketball goal system 10 relatively easy to install and simple to maintain. One skilled in the art will appreciate that the resistance mechanism 142 may be located in other suitable locations and have other suitable arrangements. In addition, as discussed above, the resistance of the resistance mechanism 142 may also be adjustable to allow the rim 70 to deflect when a load or force greater than an adjustable amount is applied to the rim.

As seen in FIGS. 13–16, the basketball goal system 10 can also have other suitable arrangements and configurations. For example, the basketball goal system 10 may have a configuration generally similar to that shown in FIGS. 11 and 12. For example, the basketball goal system 10 may be connected to a base 150 to allow the system to be readily transported and moved. Exemplary embodiments of a base that may allow the basketball goal system 10 to be transported and moved are disclosed in Assignee's U.S. Pat. Nos. 6,432,003 and 6,656,065; and Assignee's pending U.S. patent application Ser. No. 10/212,443, entitled Adjustable Wheel Engagement Assembly for Basketball Goal System and pending U.S. patent application Ser. No. 10/648,174, entitled Wheel Mounted Adjustable Roller Support Assembly for a Basketball Goal System, which are incorporated by reference in their entireties.

The basketball goal system 10 shown in FIGS. 13–16 can also include a support structure 160 that may be used to attach the backboard 12 to the support pole 40. The support structure 160 may include an upper support member 162 with a first end 164 that is attached to the backboard support assembly 52 and a second end 166 that is attached to the support pole 40. The support structure 160 may also include a lower support member 168 with a first end 170 that is attached to the backboard support assembly 52 and a second end 172 that is attached to a height adjustment mechanism 174. The lower support member 168 may also include an interior portion 176 that is attached to the support pole 40. It will be appreciated that the support structure 160, upper support member 162 and lower support member 168 can have other suitable configurations depending, for example, upon the size and configuration of the backboard 12, support frame 14 or support pole 40.

As discussed above, the height adjustment mechanism 174 may allow the height of the backboard 12 and hoop 70 to be adjusted relative to the playing. In addition, the height adjustment mechanism 174 may include one or more shock absorbers 178, springs, pistons, or the like that are desirably sized and configured to assist in controlling the movement of the height adjustment mechanism. For example, the shock absorbers 178 can be sized and configured to assist in adjusting the height of the basketball goal.

Figure 14:
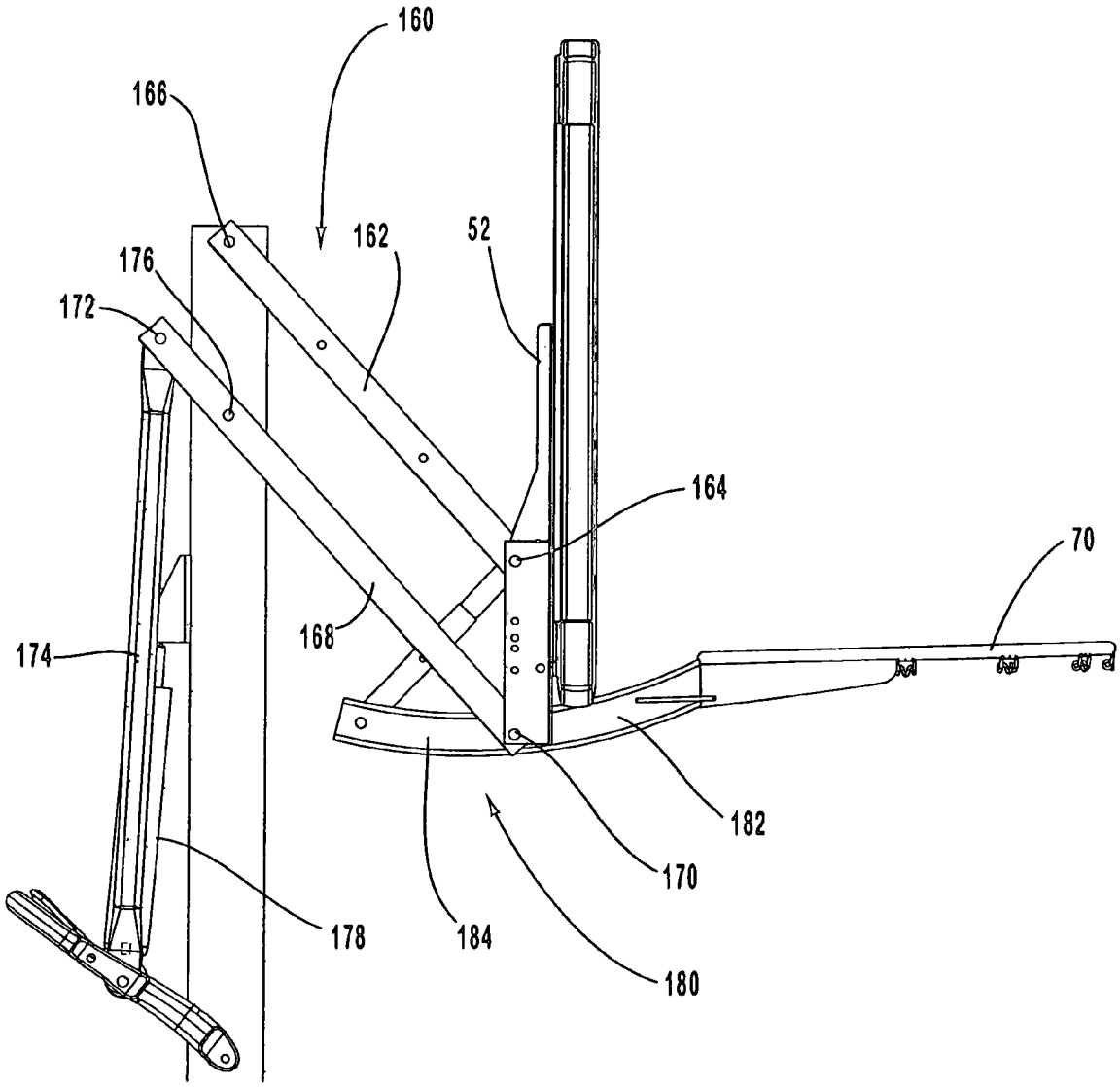
FIG. 14 is an enlarged side view of an adjustable height basketball goal assembly that can be used in conjunction with the basketball goal system shown in FIG. 13.
Figure 15:
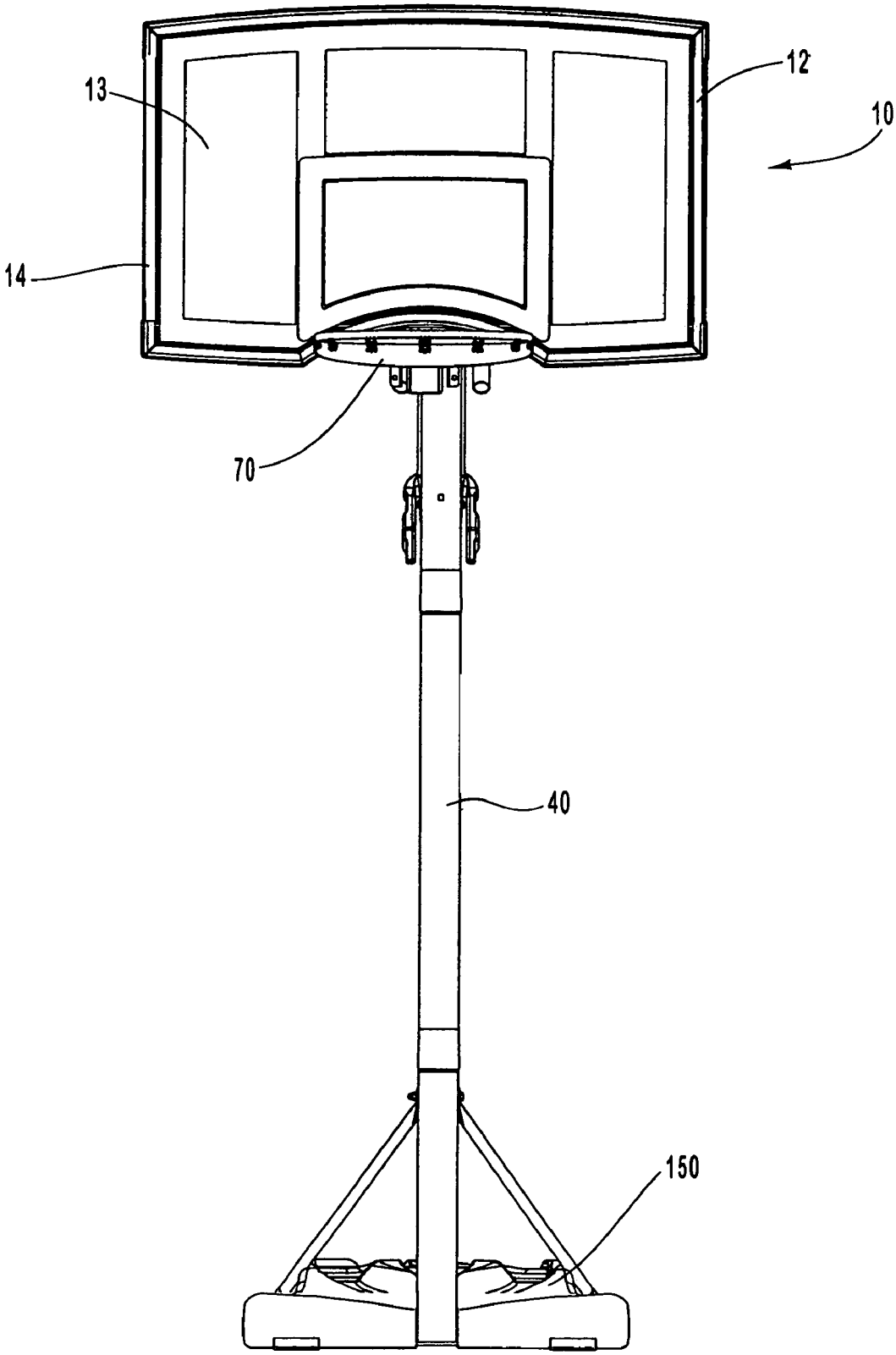
FIG. 15 is a front view of a portion of an adjustable height basketball goal assembly that can be used in conjunction with the basketball goal system shown in FIG. 13.
Figure 16:
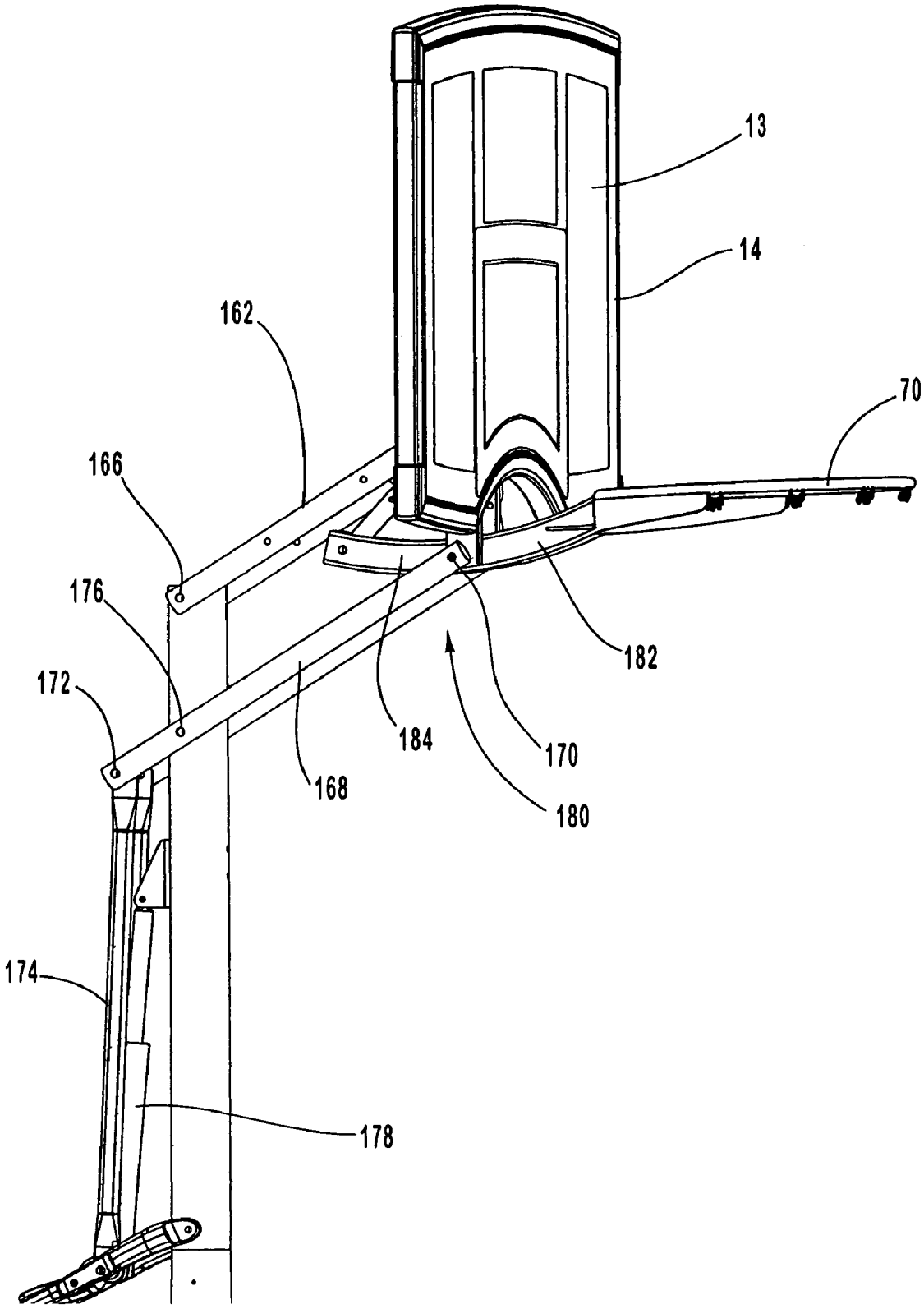
FIG. 16 is a perspective view of a portion of an adjustable height basketball goal assembly that can be used in conjunction with the basketball goal system shown in FIG. 13.

As best seen in FIG. 14, the basketball goal system 10 may also include a goal support assembly 180 that is connected to the support arms 54, 56 of the backboard support assembly 52. In particular, the support arms 54, 56 include lower ends that are connected to an elongated support member 182 of the goal support assembly 180. The elongated support member 182 preferably includes two generally parallel arms 184, 186 that are connected to the lower ends of the support arms 54, 56 by a fastener. Because the support arms 54, 56 are disposed behind the plane of the backboard 12, the connection of the goal support assembly 180 to the backboard support assembly 52 is also disposed behind the plane of the backboard. It will be appreciated, however, that the connection of the goal support assembly 130 to the backboard support assembly 52 could also be below or in front of the backboard 12. It will also be appreciated that the elongated support member 132 does not require two arms 134, 136 and, in contrast, may have other suitable configurations such as a single arm or multiple arms. Further, it will be appreciated that the elongated support member 132 may be curved, arched or have other suitable designs and arrangements.

The hoop or rim 70 is preferably disposed at an end of the goal support assembly 180 and the goal support assembly is preferably movable in order to create a breakaway basketball rim. In particular, the goal support assembly 180 is desirably pivotally connected to the lower portion of the support arms 54, 56 of the backboard support assembly 52 to allow pivotal movement of the hoop 70. Advantageously, because the goal support assembly 180 is attached to the backboard support assembly 52 and not the backboard 12, forces caused by players contacting the rim are not directly transmitted to the backboard, which helps prevent damage to the backboard. Additionally, because the goal support assembly 180 is not directly connected to the backboard 12, no openings or slots must be formed in the backboard to allow attached of the goal support assembly to the backboard, which may increase the structural integrity of the backboard.

A resistance mechanism 190 may be attached to the end of the elongated support member 182 of the goal support assembly 180. The resistance mechanism 182 may also be attached to the backboard support assembly 52 and/or the support structure 160. Preferably, the resistance mechanism 190 is attached to both the backboard support assembly 52 and the upper support member 162 of the support structure 160. More preferably, the resistance mechanism 190 is attached to the connection of the upper support member 162 to the backboard support assembly 52. Desirably, this allows the same fastener or fasteners to connect the backboard support assembly 52, support structure 160 and resistance mechanism 190. One skilled in the art will appreciate that the resistance mechanism 190 may be connected to any suitable portion of the backboard 12, backboard support assembly 52 and/or support structure 160 depending, for example, upon the configuration of the backboard, backboard support assembly and/or support structure.

As discussed above, the resistance mechanism 190 may include one or more shock absorbers, springs, pistons, or the like to control the movement of the goal support assembly 180. In addition, the resistance mechanism 190 is preferably configured to maintain the rim 70 parallel to the playing surface and hold the rim in a generally fixed position while playing basketball. When a force or load larger than a predetermined amount impacts the rim 70, the resistance mechanism 190 allows momentary deflection of the rim downwardly towards the playing surface to help absorb the force or impact on the rim. The resistance mechanism 190 is preferably sized and configured to return the rim to its original position when the force is removed or decreased below the predetermined amount. Further, while the resistance mechanism 190 is preferably located behind the plane of the backboard 12 so that it does not interfere with playing the game of basketball, the resistance mechanism could be connected to any suitable portions of the basketball goal system.

Figure 17A:
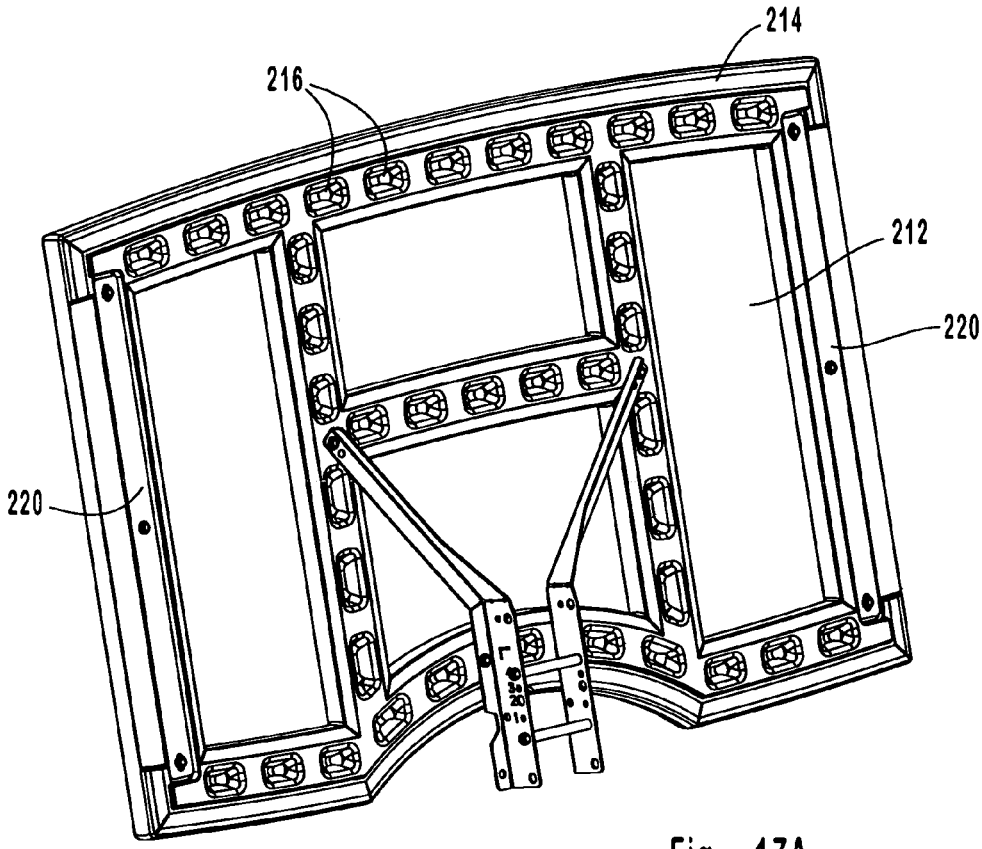
FIG. 17A is a rear perspective view of an embodiment of a backboard that can be used in conjunction with the basketball goal system.
Figure 17B:
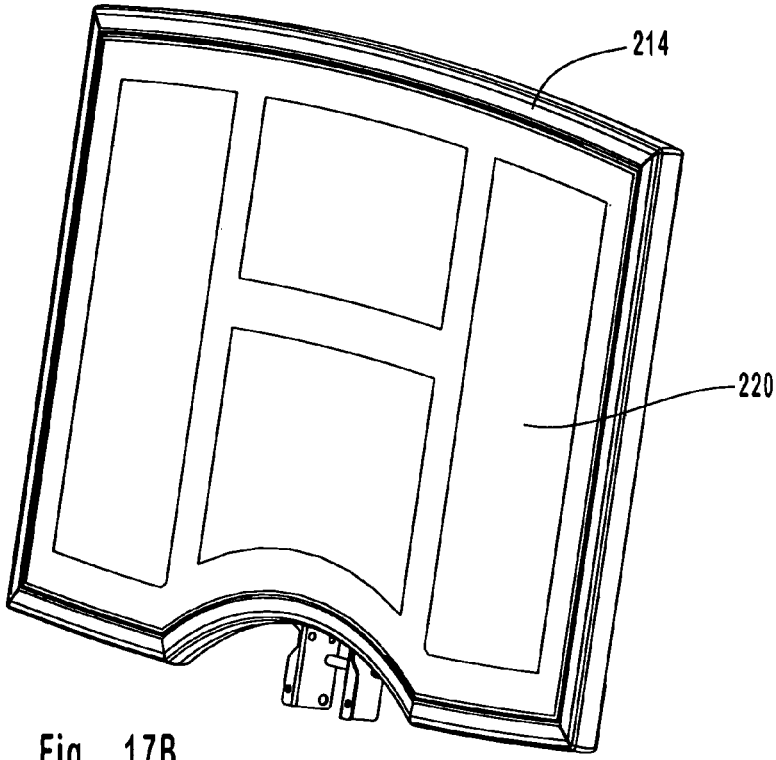
FIG. 17B is a front perspective view of the backboard shown in FIG. 17A.

As shown in FIGS. 17A and 17B, the backboard 12 may consist of a two-piece backboard with a rebound member or panel 212 and a support frame 214. The rebound member 212 is preferably attached to the front surface of the support frame 214 by an adhesive, such as disclosed in assignee's co-pending U.S. patent application Ser. No. 09/228,325, entitled System and Method for Bonding an Acrylic Surface to a Frame, which was filed on Jan. 11, 1999 and is hereby incorporated by reference in its entirety. It will be appreciated that the rebound member 212 can also be attached to the support frame 214 by one or more screws, bolts, fasteners, adhesives and the like. Of course, the backboard 10 can also consist of a unitary, one-piece structure or be constructed from a single component or material.

The rebound member 212 preferably has a generally smooth, planar outer surface so that a basketball bounces or rebounds off the rebound member in a consistent manner. The rebound member 212 is preferably constructed from plastic and, more preferably, from an acrylic sheet that has sufficient thickness so that it will not break during an ordinary game of basketball. The rebound member 212 is preferably constructed from an acrylic sheet because it is lightweight, easy to manufacture, and allows the basketball goal system 10 to be easily assembled. In addition, the rebound member 212 is preferably constructed from acrylic or other suitable clear, transparent or generally translucent materials so that light can pass through the backboard 10. This creates a backboard 10 that is similar in appearance and characteristics to that used in professional and major college games. One skilled in the art, however, will realize that the rebound member 212 can be constructed from other suitable materials and the rebound member can be constructed from opaque or other types of solid materials.

The support frame 214 is preferably constructed from a lightweight material, such as plastic. Desirably, the support frame 214 is constructed from blow-molded plastic to create a strong, lightweight and durable frame. In greater detail, the support frame 214 is preferably constructed using a blow-molded plastic process, and the frame includes two opposing walls or surfaces that are separated by a given distance in order to create a strong and sturdy structure. In addition, the interior portion of the support frame 214 is preferably generally hollow to create a lightweight structure, but the support frame does not have to be hollow. The support frame 214 is preferably designed to withstand repeated impacts with a basketball or other similar objects. One skilled in the art will appreciate that the support frame 214 can also be constructed using other suitable methods and processes such as injection molding, extrusion molding, compression molding, and the like. In addition, one skilled in the art will appreciate that the support frame 214 can be constructed from other materials with desired characteristics such as metal, wood, acrylic, Lexan®, composites, and the like.

The basketball backboard support frame 214 is preferably constructed from blow-molded plastic because it can easily be formed into any desired size and configuration. The support frame 214 is also desirably constructed from blow-molded plastic because it is durable, weather resistant and generally temperature insensitive. Advantageously, because the basketball backboard support frame 214 can be constructed from blow-molded plastic, it will not corrode, rust or otherwise deteriorate over time.

In addition, as discussed in more detail below, the support frame 214 may allow additional weight or mass to be selectively or permanently attached to enhance the rebounding characteristics of the backboard 10. Because the additional weight or mass may be selectively connected to the support frame 214, the backboard 10 may be shipped to the retailer or consumer without the weight or mass attached to decrease shipping costs. The additional weight or mass can then be added by the retailer or consumer, if desired.

The frame 214 may also include other features such as depressions 216 or "tack-offs." The depressions 216, which extend from one surface towards the other surface, are desirably sized and configured to increase the strength and/or rigidity of the support frame 214. Preferably, the depressions 216 extend from one surface and contact or engage an opposing surface, but the depressions do not have to contact or engage the opposing surface. The depressions 216 are desirably formed in the back or rear surface of the support frame 214 so that the depressions are generally not visible while playing the game of basketball. The depressions 216, however, may also be formed in the front surface of the support frame 214. These depressions 216 may be covered in whole or in part by the rebound member 212. In addition, one or more depressions 216 may be formed in the rear surface of the support frame 214 and one or more depressions may be formed in the front surface of the frame, and these opposing depressions may be generally aligned. Desirably, at least a portion of these opposing depressions 216 contract or engage each other, but the opposing depressions do not have touch or engage. One skilled in the art will appreciate that the number, size and location of the depressions 216 may depend upon factors such as the desired strength of the support frame 214.

As shown in FIG. 17A, the depressions 216 preferably have a generally trapezoidal configuration. Advantageously, the trapezoidal configuration provides desirable bearing and torsional characteristics for the basketball backboard 12. For example, the trapezoidal shape appears to prevent the support frame 214 from bending or yielding when a basketball rebounds from the backboard 12. Thus, the backboard 12 tends to have rebounding characteristics that are similar to larger and heavier backboards. It will be understood, however, that the depressions 216 could have any suitable configurations such as rectangular, oblong, and the like.

As shown in FIG. 17A, one or more masses or weights 220 may be attached to selected portions of the backboard 12. The weights 220 are preferably attached proximate the outer edges or periphery of the backboard 12 and, in particular, to the left and right sides of the backboard. Positioning the weights 220 at or near the edges of the backboard 12 may help create a perimeter-weighted backboard. In addition, the added weights 220 may help prevent the backboard 12 from undesirably moving or deflecting when struck by the basketball, which may provide for more consistent rebounding of the basketball. In addition, the weights 220 may be attached to portions of the backboard 12 that are disposed away from the support structure to help improve rebounding characteristics. It will be appreciated that the weights 220 can also be positioned in any desired locations and the weights can be divided into any suitable number depending, for example, upon the desired characteristics of the backboard 12.

The weights 220 can advantageously be attached to the backboard 12 after shipping and transportation of the basketball goal system 10, which may decrease costs. In addition, if the weights 220 are attached to the backboard 12 after the basketball goal system 10 is assembled, then that may make assembly of a basketball system easier for the consumer or retailer. The weights 220, however, can also be attached to the backboard 12 at any suitable time, including before, during or after the manufacturing process.

The weights 220 may be attached to or positioned within internal portions of the backboard 12. For example, the backboard 12 may include one or more openings that are sized and configured to be filled with materials such as water or sand. Thus, the backboard 12 may include one or more containers that are sized and configured to hold a predetermined quantity of water or sand. The containers may include a lid or top to prevent the water or sand from escaping. It will be appreciated that any suitable type of material may be used to create the weights 220, including pieces of metal, rocks, or other weight bearing items.

Advantageously, the weights 220 may also be sized and configured to increase the rigidity or strength of the backboard 12. For example, the weights 220 may consist of generally rigid materials that are not easily bent or curved. In particular, the weights 220 may consist of elongated metal rods or bars that are positioned proximate the outer edges of the backboard 12. The metal rods may be constructed from steel or other generally inflexible materials to increase the stiffness of the backboard 12. While the weights 220 are desirably positioned about the perimeter of the backboard 12, all or a portion of the weights 220 may be positioned proximate the center or other portions of the backboard. Additional details and alternative embodiments of various backboards that may be used in connection with the basketball goal system are disclosed in Assignee's copending U.S. patent application Ser. No. 10/722,664, entitled Basketball Backboard, which is incorporated by reference in its entirety.

Figure 18A:
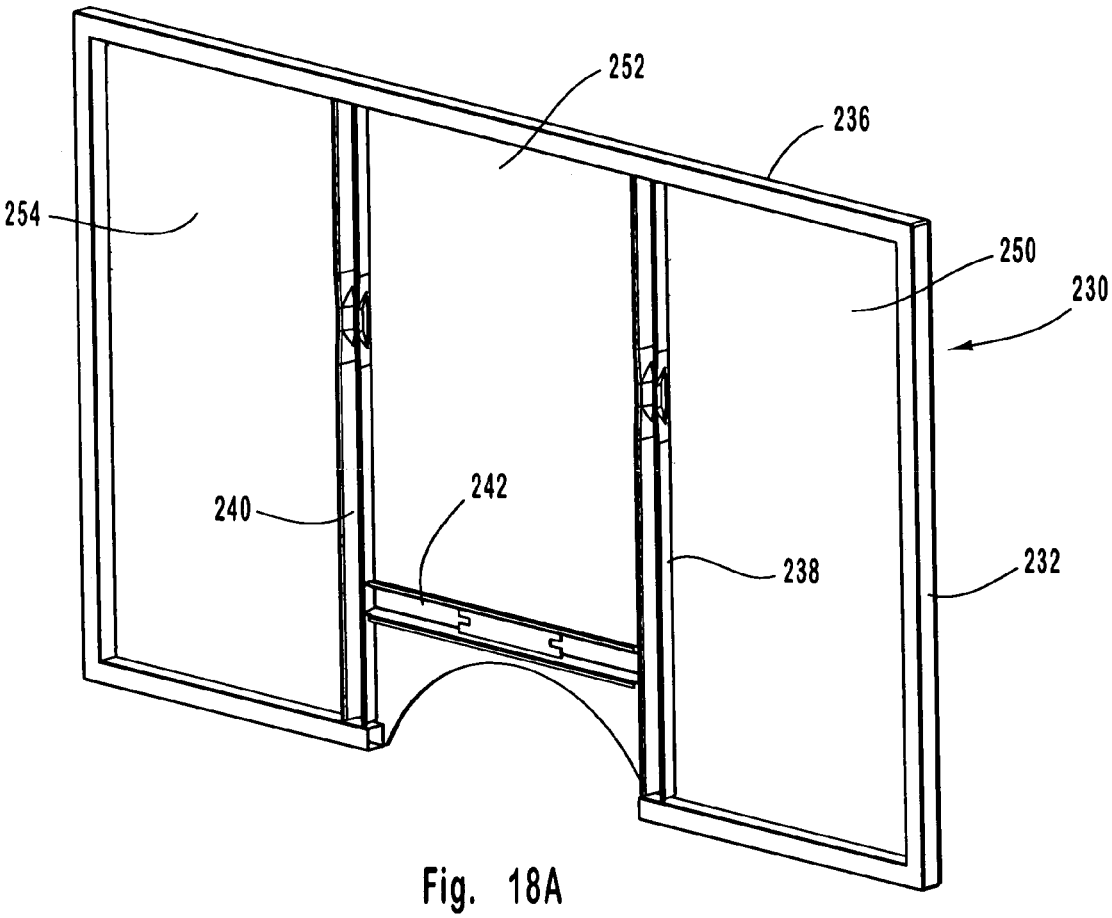
FIG. 18A is a perspective view of an embodiment of a frame for a basketball backboard that can be used in conjunction with the basketball goal system.
Figure 18B:
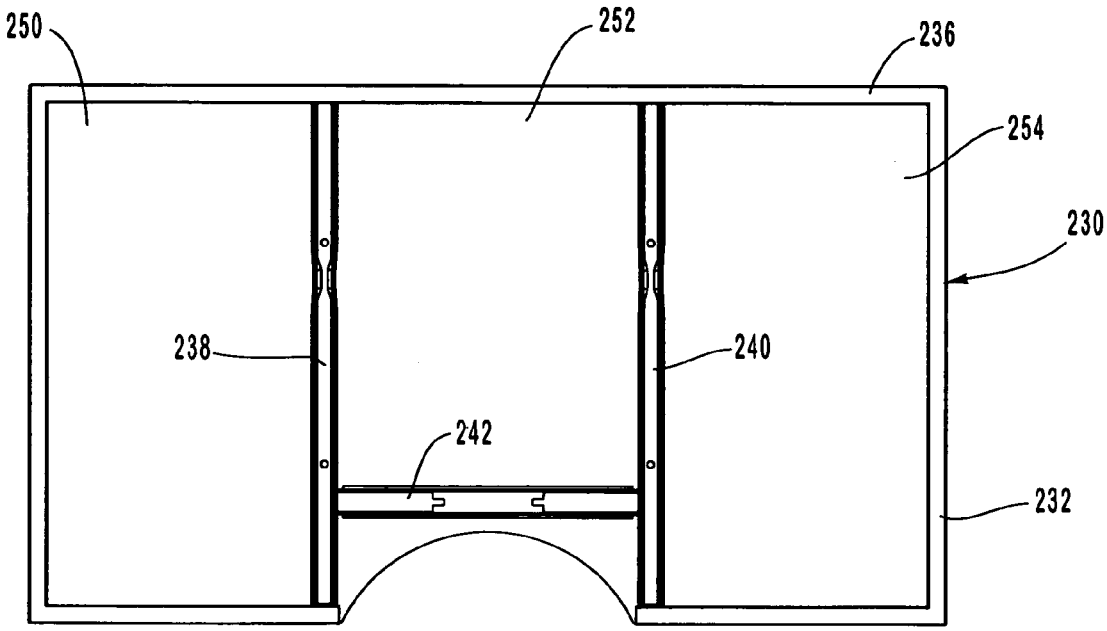
FIG. 18B is a front view of the frame shown in FIG. 18A.
Figure 19A:
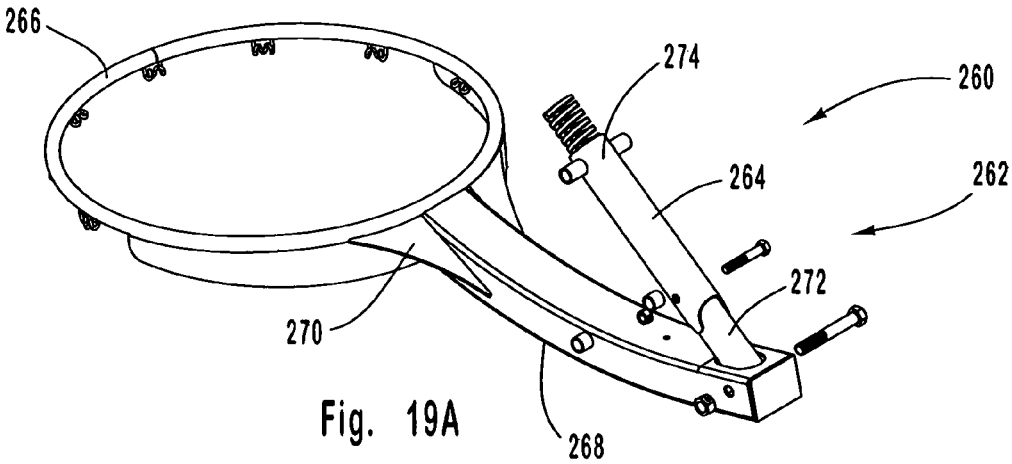
FIG. 19A is a perspective view of an embodiment of a rim assembly that can be used in conjunction with the basketball goal system.
Figure 19B:
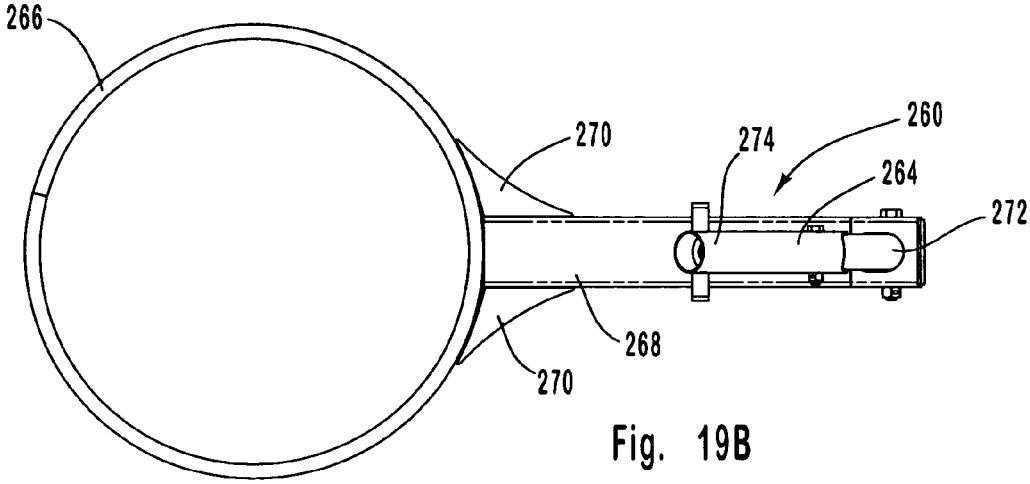
FIG. 19B is a top view of the rim assembly shown in FIG. 19A.
Figure 19C:
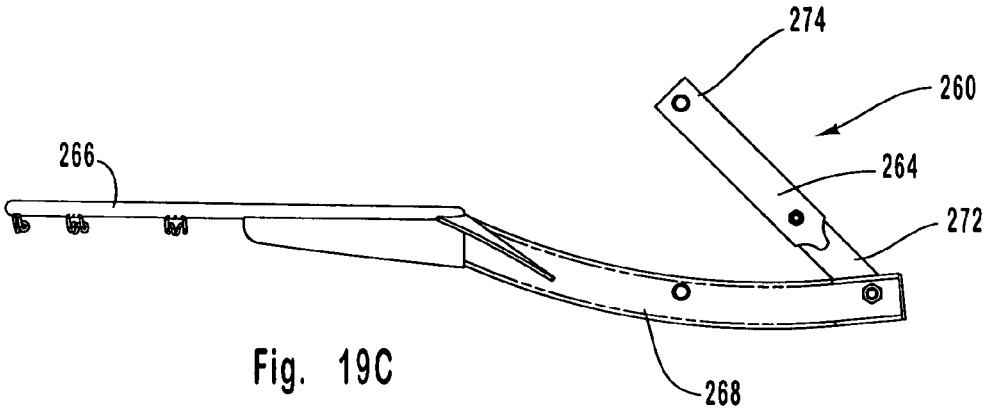
FIG. 19C is a side view of the rim assembly shown in FIG. 19A.
Figure 19D:
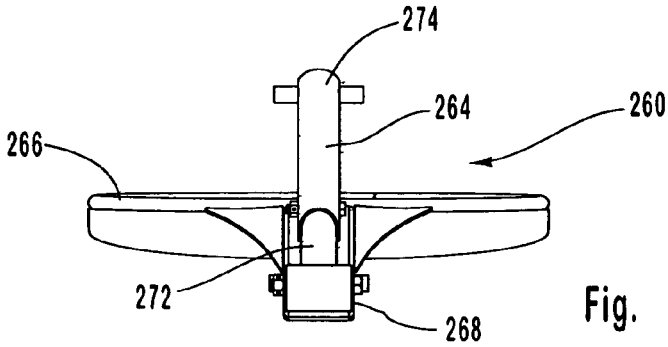
FIG. 19D is a rear view of the rim assembly shown in FIG. 19A.
Figure 20A:
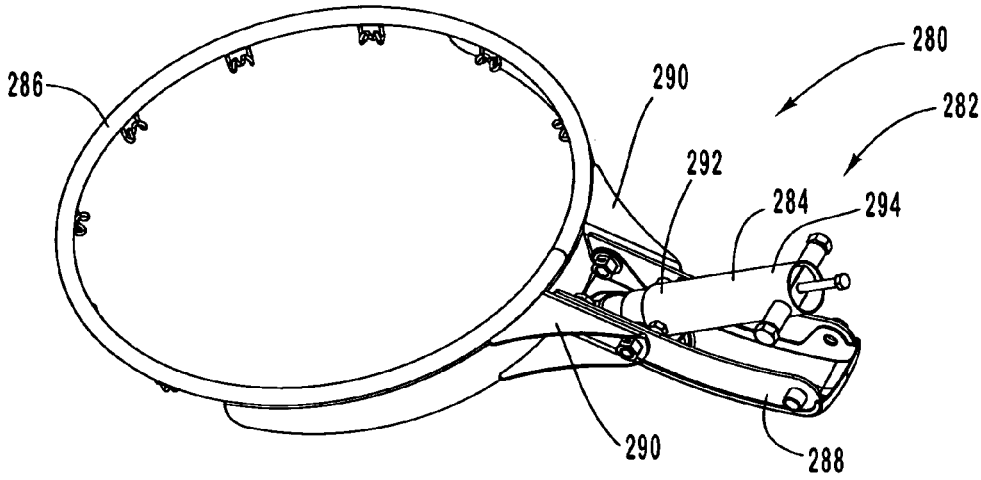
FIG. 20A is a perspective view of another embodiment of a rim assembly that can be used in conjunction with the basketball goal system.
Figure 20B:
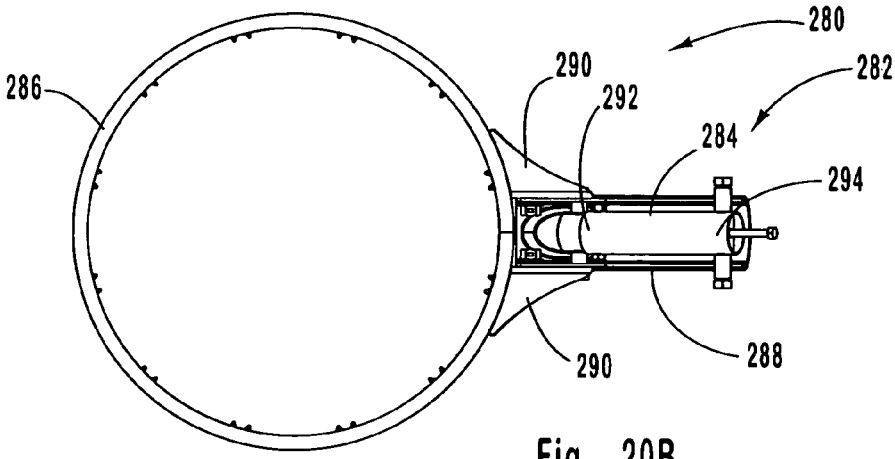
FIG. 20B is a top view of the rim assembly shown in FIG. 20A.
Figure 20C:
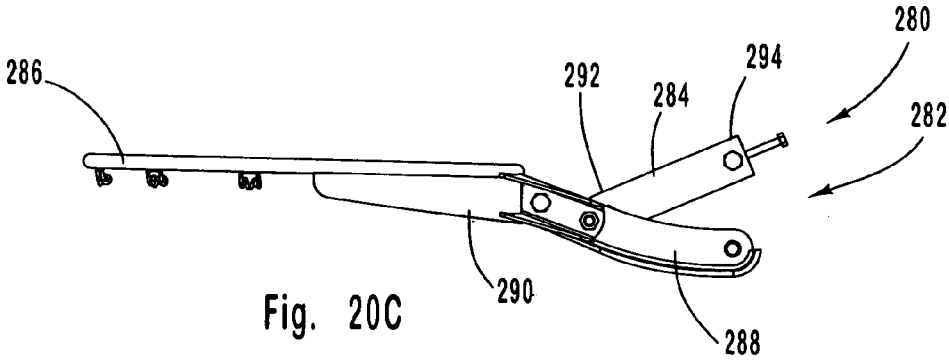
FIG. 20C is a side view of the rim assembly shown in FIG. 20A.
Figure 20D:
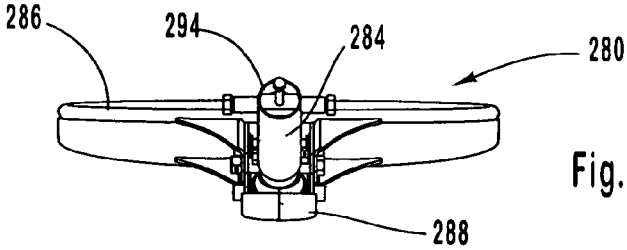
FIG. 20D is a rear view of the rim assembly shown in FIG. 20A.

As shown in FIGS. 18A and 18B, the backboard goal system 10 may also be used in connection with various suitable types of basketball backboards 230. For example, the backboard 230 may include a frame 232 that supports a rebound member 234. The frame 232 is desirably constructed from a relatively strong and high-strength material such as metal or steel. The frame 232 preferably has a generally rectangular configuration with a perimeter 236 that is sized and configured to support the rebound member 234. The frame 232 may also include two generally parallel support members 238, 240 that extend from a lower portion of the frame 232 to an upper portion of the frame 234. In addition, the frame 232 may include a cross bar 242 that interconnects the two generally parallel support members 238, 240. One skilled in the art will recognize that the support members 238, 240 can have other suitable size and configuration depending, for example, upon the intended use of the frame 232 or backboard goal system. One skilled in the art will also appreciate that the backboard 230 and/or frame 232 may have other suitable shapes and configurations depending, for example upon the intended use of the basketball goal system 10.

The support members 238, 240 desirably divide the frame 232 into three distinctive openings or sections 250, 252, and 254. Advantageously, the support members 238, 240 and the outer edges of the frame 232 may securely support the rebound member 234 such that a basketball rebounding from the backboard 230 will deflect the backboard a minimal amount. This may create a backboard 230 with very good rebounding characteristics. Additionally, the openings 250, 252, 254 allow a lightweight basketball backboard to be created and the openings also allow a generally see-through basketball backboard to be created, if desired.

The support members 238, 240 are preferably sized and configured such that a basketball target may cover or hide at least a portion of the support arms. It will be appreciated, however, that the support members 238, 240 can have other suitable sizes and configurations depending upon the intended use of the basketball goal system. For example, the support frame 232 may include only one support arm or more than two support arms. One skilled in the art will also appreciate that the other suitable structures and designs may be used to support the backboard 230 and/or rebound member 234.

As discussed above, the basketball goal system 10 may include a breakaway rim assembly that allows the rim to pivot or move when a force greater than a predetermined amount is applied to the rim. Additionally, as discussed above, the breakaway rim assembly may include a resistance mechanism that holds or maintains the rim generally parallel to the playing surface. The resistance mechanism, however, allows the rim to move downwardly when a force exceeding the preset amount is applied to the rim to help prevent damage to the rim and/or goal assembly. The resistance mechanism desirably returns the rim to its normal position that is generally parallel to the playing surface when the force applied to the rim is removed or it no longer exceeds the predetermined amount.

As shown in FIGS. 19A–19D, an exemplary embodiment of the basketball goal system 260 includes a breakaway rim assembly 262 with a resistance mechanism 264. The breakaway rim assembly 262 includes a rim 266 and a support member 268 attached to the rim. The support member 268 preferably has a generally C-shaped cross section and it is attached to the rim 266 by two or more flanges 270. The rim assembly 262, however, could have other suitable shapes and sizes, and the rim 266 could be an integral part of the rim assembly. As discussed above, one portion of the breakaway rim assembly 262 is preferably attached to a backboard support assembly, but the rim assembly could also be attached to the support pole or backboard, for example.

In greater detail, the resistance mechanism 264 includes a first end 272 that is attached to the support member 268 and a second end 274 that is attached to the backboard, backboard support assembly and/or a support structure, such as the support structure 100 shown in FIGS. 11 and 12, or the support structure 160 shown in FIGS. 13–16. One skilled in the art will understand that the resistance mechanism 264 may be attached to any suitable portion of the basketball goal system 10 depending, for example, upon the size and configuration of the backboard 12 and/or support system.

As shown in FIGS. 20A–20D, another exemplary embodiment of the basketball goal system 280 includes a breakaway rim assembly 282 with a resistance mechanism 284. The breakaway rim assembly 282 includes a rim 286 and a support member 288 attached to the rim. The support member 288 preferably has a generally C-shaped cross section and it is attached to the rim 286 by two or more flanges 290. The rim assembly 282, however, could have other suitable shapes and sizes, and the rim 286 could be an integral part of the rim assembly. As discussed above, one portion of the breakaway rim assembly 282 is preferably attached to a backboard support assembly, but the rim assembly could also be attached to the support pole or backboard, for example.

The resistance mechanism 284 includes a first end 292 that is attached to the support member 288 and a second end 294 that is attached to the backboard, backboard support assembly and/or a support structure, such as the support structure 100 shown in FIGS. 11 and 12, or the support structure 160 shown in FIGS. 13–16. One skilled in the art will understand that the resistance mechanism 284 may be attached to any suitable portion of the basketball goal system 10 depending, for example, upon the size and configuration of the backboard 12 and/or support system.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A basketball goal system comprising:

a backboard including a top portion, a bottom portion, a front portion and a rear portion;

a support structure that is sized and configured to position the backboard above a surface;

a backboard support assembly connected to the backboard and the support structure;

a goal support assembly including a rim and a support member with a first end that extends substantially beyond a plane that is generally aligned with the front portion of the backboard and is attached to the rim and a second end that extends substantially beyond a plane that is generally aligned with the rear portion of the backboard, an intermediate portion of the support member of the goal support assembly being attached to the backboard support assembly at an attachment point that is at least substantially behind the plane that is generally aligned with the front of the backboard; and a resistance mechanism including a first end and a second end, the first end of the resistance mechanism being connected to the support member of the goal support assembly and the second end being connected to the support structure, the resistance mechanism being sized and configured to allow the rim to move between a first position in which the rim is generally perpendicular to the front portion of the backboard and a second position in which the rim is disposed at an angle to the front portion of the backboard, the resistance mechanism being sized and configured to bias the rim into the first position.

2. The basketball goal system as in claim 1, wherein the second end of the resistance mechanism is connected to the backboard support assembly.

3. The basketball goal system as in claim 2, wherein the resistance mechanism is connected to a rear portion of the elongated support and the resistance mechanism is disposed behind the plane that is generally aligned with the front surface of the backboard.

4. The basketball goal system as in claim 1, wherein the first end of the resistance mechanism is connected to the second end of the goal support assembly.

5. The basketball goal system as in claim 1, wherein the resistance mechanism is disposed behind the plane that is generally aligned with the front portion of the backboard.

6. The basketball goal system as in claim 1, wherein the backboard support assembly includes two arms and each of the arms include an upper portion that is connected to the backboard and a lower portion that is connected to the goal support assembly.

7. The basketball goal system as in claim 1, wherein the elongated support is connected to a portable basketball system.

8. The basketball goal system as in claim 1, wherein the height of the backboard and rim is adjustable relative to a playing surface.

9. A basketball goal system comprising:

a backboard;

a support structure;

a backboard support assembly connecting the backboard and the support structure, the backboard support assembly including an end that extends below a lower portion of the backboard;

a goal support assembly including a rim and an elongated support member, the elongated support member including a first end that is disposed beyond a front portion of the backboard and is attached to the rim, the elongated support member including a second end that is disposed beyond a rear portion of the backboard, the goal support assembly being connected to the end of the backboard support assembly that extends below a lower portion of the backboard at a connection point that is spaced apart from and below the lower portion of the backboard; and a resistance mechanism including a first end and an opposing second end, the first end of the resistance mechanism being connected to the elongated support member of the goal support assembly, the second end of the resistance mechanism being spaced apart from the elongated support assembly, the resistance mechanism being sized and configured to allow the goal support assembly to move from a first position to a second position when a force greater than a predetermined amount of force is applied to the rim, the resistance mechanism being sized and configured to move the goal support assembly from the second position to the first position when the force applied to the rim is removed.

10. The basketball goal system as in claim 9, wherein the resistance mechanism is connected to the support pole and the resistance mechanism is disposed behind a plane that is generally aligned with a front surface of the backboard.

11. The basketball goal system as in claim 9, wherein the resistance mechanism is connected to the backboard support assembly and the resistance mechanism is disposed behind a plane that is generally aligned with a front surface of the backboard.

12. The basketball goal system as in claim 9, wherein the backboard support assembly includes at least one support arm that is pivotally connected to the goal support assembly at a connection point that is disposed at least substantially behind a plane that is generally aligned with the front of the backboard.

13. The basketball goal system as in claim 9, wherein the elongated member of the goal support assembly is pivotally connected to the backboard support assembly at a connection point that is disposed at least substantially behind a plane that is generally aligned with the front of the backboard.

14. A basketball goal system comprising:

a backboard;

a support that is sized and configured to position the backboard above a playing surface;

a backboard support assembly that is sized and configured to connect the backboard to the support;

a goal support assembly including a rim and an elongated member with a first end that extends substantially beyond a plane that is generally aligned with the front of the backboard and is attached to the rim and a second end that extends substantially beyond a plane that is generally aligned with the rear of the backboard, an intermediate portion of the goal support assembly being connected to the backboard support assembly; and a resistance mechanism including a first end and an opposing second end, the first end of the resistance mechanism being connected to the goal support assembly, the second end of the resistance mechanism being spaced apart from the goal support assembly, the resistance mechanism being sized and configured to allow the goal support assembly to move from a first position to a second position when a force greater than a predetermined amount is applied to the rim, the resistance mechanism being sized and configured to move the goal support assembly from the second position to the first position when the force applied to the rim is removed.

15. The basketball goal system as in claim 14, the goal support assembly is attached to the backboard support assembly behind a plane that is generally aligned with the front surface of the backboard.

16. The basketball goal system as in claim 14, wherein the resistance mechanism is connected to a rear portion of the elongated member of the goal support assembly and the resistance mechanism is disposed behind a plane that is generally aligned with the front surface of the backboard.

17. The basketball goal system as in claim 14, wherein the resistance mechanism is connected to the backboard support assembly.

18. The basketball goal system as in claim 14, wherein the resistance mechanism is connected to the support.

19. The basketball goal system as in claim 14, wherein the backboard support assembly includes two arms and each of the arms include an upper portion that is connected to the backboard and a lower portion that is connected to the goal support assembly.

20. The basketball goal system as in claim 14, wherein the support is connected to a portable basketball system.

21. The basketball goal system as in claim 14, wherein the height of the backboard and rim is adjustable relative to a playing surface.

22. The basketball goal system as in claim 14, further comprising a support structure that interconnects the support and the backboard support assembly.

23. The basketball goal system as in claim 14, wherein the backboard support assembly includes at least one support arm that is pivotally connected to the goal support assembly at a connection point that is disposed at least substantially behind a plane that is generally aligned with the front of the backboard.

24. The basketball goal system as in claim 14, wherein the elongated member of the goal support assembly is pivotally connected to the backboard support assembly at a connection point that is disposed at least substantially behind a plane that is generally aligned with the front of the backboard.

25. A basketball goal system comprising:

a backboard;

a support structure that is sized and configured to position the backboard above a playing surface;

a backboard support assembly connected to the backboard, the backboard support assembly including a first support arm and a second support arm;

a goal support assembly including a rim and an elongated member, the elongated member including a first elongated arm and a second elongated arm, the first elongated arm being pivotally attached to the first support arm at an attachment point that is at least substantially behind a plane that is generally aligned with a front portion the backboard, the second elongated arm being pivotally attached to the second support arm at attachment point that is at least substantially behind the plane that is generally aligned with the front portion the backboard; and a resistance mechanism including a first end and an opposing second end, the first end being connected to the elongated member of the goal support assembly at an attachment point that is at least substantially behind the plane that is generally aligned with the front portion the backboard, the second end of the resistance mechanism being spaced apart from the goal support assembly, the resistance mechanism being sized and configured to allow the goal support assembly to move from a first, generally level position to a second, collapsed position when a force greater than a predetermined amount is applied to the rim, the resistance mechanism being sized and configured to move the goal support assembly from the second position to the first position when the force applied to the rim is removed.

26. The basketball goal system as in claim 25, wherein the resistance mechanism is also connected to the backboard support assembly.

27. The basketball goal system as in claim 25, wherein the resistance mechanism is also connected to the support structure.

* * * * *

UNITED STATES PATENT AND TRADEMARK OFFICE

CERTIFICATE OF CORRECTION

PATENT NO. : 7,097,574 B2
APPLICATION NO. : 10/737034
DATED : August 29, 2006
INVENTOR(S) : Nye et al.

It is certified that error appears in the above-identified patent and that said Letters Patent is hereby corrected as shown below:

Title Page
Item 75, Inventors, Line 2, change “Fannington” to --Farmington--

Column 2
Line 53, after “known” insert --to--

Column 10
Line 51, change “lateral support members 42, 44” to --support arms 24, 26--

Column 12
Line 8, change “attached” to --attachment--

Column 13
Line 2, change “ember” to --member--

Column 17
Line 65, change “130” to --180--
Line 67, change “132” to --182--

Column 18
Line 1, change “134, 136” to --184, 186--
Line 4, change “132” to --182--

Column 19
Line 4, change “10” to --12--
Line 58, change “10” to --12--
Line 60, change “10” to --12--

UNITED STATES PATENT AND TRADEMARK OFFICE

CERTIFICATE OF CORRECTION

PATENT NO. : 7,097,574 B2
APPLICATION NO. : 10/737034
DATED : August 29, 2006
INVENTOR(S) : Nye et al.

It is certified that error appears in the above-identified patent and that said Letters Patent is hereby corrected as shown below:

Column 21
Line 36, change "size" to --sizes--
Line 37, change "configuration" to --configurations--

Signed and Sealed this

Ninth Day of January, 2007

JON W. DUDAS
*Director of the United States Patent and Trademark Office*